US011374318B2

(12) United States Patent
Morita

(10) Patent No.: US 11,374,318 B2
(45) Date of Patent: Jun. 28, 2022

(54) BUTLER MATRIX CIRCUIT, PHASED ARRAY ANTENNA, FRONT-END MODULE, AND WIRELESS COMMUNICATION TERMINAL

(71) Applicant: Sony Semiconductor Solutions Corporation, Kanagawa (JP)

(72) Inventor: Shinya Morita, Tokyo (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 132 days.

(21) Appl. No.: 16/769,589

(22) PCT Filed: Sep. 6, 2018

(86) PCT No.: PCT/JP2018/032973
§ 371 (c)(1),
(2) Date: Jun. 4, 2020

(87) PCT Pub. No.: WO2019/116648
PCT Pub. Date: Jun. 20, 2019

(65) Prior Publication Data
US 2020/0313294 A1 Oct. 1, 2020

(30) Foreign Application Priority Data
Dec. 11, 2017 (JP) ..... JP2017-236993

(51) Int. Cl.
*H01Q 3/40* (2006.01)
*H01Q 1/24* (2006.01)
(Continued)

(52) U.S. Cl.
CPC ..... *H01Q 3/40* (2013.01); *H01P 5/16* (2013.01); *H01Q 1/24* (2013.01); *H01Q 21/00* (2013.01); *H01Q 21/06* (2013.01); *H01Q 21/065* (2013.01)

(58) Field of Classification Search
CPC ..... H01Q 3/40; H01Q 1/24; H01Q 21/065; H01Q 21/00; H01Q 21/06; H01P 5/16
(Continued)

(56) References Cited

U.S. PATENT DOCUMENTS 4,123,759 A 10/1978 Hines et al.
4,965,605 A 10/1990 Chang et al.
(Continued)

FOREIGN PATENT DOCUMENTS

CN 101051860 A 10/2007
JP 03-106102 A 5/1991
(Continued)

OTHER PUBLICATIONS

International Search Report and Written Opinion dated Nov. 27, 2018 for PCT/JP2018/032973 filed on Sep. 6, 2018, 8 pages including English Translation of the International Search Report.
(Continued)

*Primary Examiner* — Hai V Tran
(74) *Attorney, Agent, or Firm* — Xsensus LLP

(57) ABSTRACT

[Object] There is provided a Butler matrix circuit that makes it possible to further reduce volume and power consumption and to obtain symmetrical radiation characteristics.
[Solution] There is provided a Butler matrix circuit including: four processing-circuit-side terminals; four antenna-side terminals; a first 90° hybrid coupler coupled to a first processing-circuit-side terminal and a second processing-circuit-side terminal; a second 90° hybrid coupler coupled to a third processing-circuit-side terminal and a fourth process-
(Continued)

ing-circuit-side terminal; a third 90° hybrid coupler coupled to a first antenna-side terminal and a third antenna-side terminal; a fourth 90° hybrid coupler coupled to a second antenna-side terminal and a fourth antenna-side terminal; a first 90° delay circuit provided between the first 90° hybrid coupler and the third 90° hybrid coupler; and a second 90° delay circuit provided between the first 90° hybrid coupler and the fourth 90° hybrid coupler.

12 Claims, 22 Drawing Sheets

(51) Int. Cl.
*H01Q 21/06* (2006.01)
*H01P 5/16* (2006.01)
*H01Q 21/00* (2006.01)

(58) Field of Classification Search
USPC ..... 343/853
See application file for complete search history.

(56) References Cited

U.S. PATENT DOCUMENTS 6,252,560 B1 * 6/2001 Tanaka ..... H01Q 21/08 342/371
8,928,528 B2 * 1/2015 Harel ..... H01Q 3/26 342/373
2005/0035825 A1 * 2/2005 Carson ..... H01Q 21/0075 333/117
2010/0225539 A1 * 9/2010 Margomenos ..... G01S 7/032 342/373
2010/0283703 A1 * 11/2010 Chen ..... H01Q 21/24 343/836
2012/0280884 A1 * 11/2012 DiNallo ..... H01Q 3/26 343/893
2014/0285284 A1 * 9/2014 Kim ..... H01Q 3/40 333/117
2015/0349421 A1 * 12/2015 Sharawi ..... H01Q 21/0006 342/373

FOREIGN PATENT DOCUMENTS

JP 08-250922 A 9/1996
JP 2002-057515 A 2/2002
JP 2016-208223 A 12/2016
KR 1700403 B1 2/2017
KR 1727488 B1 4/2017
WO 2008/145037 A1 12/2008

OTHER PUBLICATIONS

Chiba et al., "Beam-Space rcular Smart Antenna Fed by Hybrid Circuits," IEEE Antennas and Propagation Society International Symposium, IEEE, Jul. 8, 2001, pp. 224-227.
Extended European search report dated Jan. 13, 2021, in corresponding European patent Application No. 18888427.4, 9 pages.

* cited by examiner

OUTPUT PORT

| INPUT PORT | B1 | B2 | B3 | B4 |
|---|---|---|---|---|
| A1 | 90 | 180 | 0 | 90 |
| A2 | 180 | 90 | 90 | 0 |
| A3 | 90 | 180 | 180 | 270 |
| A4 | 180 | 90 | 270 | 180 |

[deg]

C1

| | | | |
|---|---|---|---|
| 90° | 180° | 270° | 360° |
| 0° | 90° | 180° | 270° |

C2

| | | | |
|---|---|---|---|
| 180° | 90° | 0° | -90° |
| 90° | 0° | -90° | -180° |

C3

| | | | |
|---|---|---|---|
| 90° | 180° | 270° | 360° |
| 180° | 270° | 360° | 90° |

C4

| | | | |
|---|---|---|---|
| 180° | 90° | 0° | -90° |
| 270° | 180° | 90° | 0° |

OUTPUT PORT

| INPUT PORT | | B1 | B2 | B3 | B4 |
|---|---|---|---|---|---|
| | A1 | 45 | 90 | 135 | 180 |
| | A2 | 135 | 0 | -135 | -270 |
| | A3 | -270 | -135 | 0 | 135 |
| | A4 | 180 | 135 | 90 | 45 |

[deg]

BUTLER MATRIX CIRCUIT, PHASED ARRAY ANTENNA, FRONT-END MODULE, AND WIRELESS COMMUNICATION TERMINAL

CROSS-REFERENCE TO RELATED APPLICATIONS

The present application is based on PCT filing PCT/JP2018/032973, filed Sep. 6, 2018, which claims priority to JP 2017-236993, filed Dec. 11, 2017, the entire contents of each are incorporated herein by reference.

TECHNICAL FIELD

The present disclosure relates to a Butler matrix circuit, a phased array antenna, a front-end module, and a wireless communication terminal.

BACKGROUND ART

In a fifth-generation mobile communication system (5G) which is currently being prepared for practical use, it is planned to use a millimeter wave band signal having a frequency of about several tens of GHz in order to improve a transmission rate significantly. Spatial attenuation is large in the millimeter wave band signal; therefore, it has been considered, for the fifth-generation mobile communication system, to apply, to a mobile terminal, a phased array antenna which has been heretofore used mainly in a base station, in order to obtain a necessary antenna gain. It is to be noted that examples of the phased array antenna and a phase circuit included therein include a matrix circuit disclosed in PTL 1 below and a phased array antenna using the circuit.

CITATION LIST

Patent Literature

PTL 1: Japanese Unexamined Patent Application Publication No. 2002-57515

SUMMARY OF THE INVENTION

Problem to be Solved by the Invention

In order to ensure portability of a mobile terminal, it has been requested that volume and power consumption of the mobile terminal be reduced. Accordingly, a phased array antenna to be mounted on the mobile terminal is requested to have symmetrical radiation characteristics as well as to further reduce the volume and power consumption.

Accordingly, the present disclosure proposes a novel and improved Butler matrix circuit, phased array antenna, front-end module, and wireless communication terminal that make it possible to further reduce volume and power consumption as well as to achieve symmetrical radiation characteristics.

Means for Solving the Problem

According to the present disclosure, there is provided a Butler matrix circuit including: four processing-circuit-side terminals; four antenna-side terminals; a first 90° hybrid coupler coupled to a first processing-circuit-side terminal and a second processing-circuit-side terminal; a second 90° hybrid coupler coupled to a third processing-circuit-side terminal and a fourth processing-circuit-side terminal; a third 90° hybrid coupler coupled to a first antenna-side terminal and a third antenna-side terminal; a fourth 90° hybrid coupler coupled to a second antenna-side terminal and a fourth antenna-side terminal; a first 90° delay circuit provided between the first 90° hybrid coupler and the third 90° hybrid coupler; and a second 90° delay circuit provided between the first 90° hybrid coupler and the fourth 90° hybrid coupler, in which the second 90° hybrid coupler is directly coupled to the third and fourth 90° hybrid couplers.

In addition, according to the present disclosure, there is provided a phased array antenna including: one or a plurality of Butler matrix circuits; and an array antenna including a plurality of antennas, in which each of the plurality of Butler matrix circuits includes four processing-circuit-side terminals, four antenna-side terminals, a first 90° hybrid coupler coupled to a first processing-circuit-side terminal and a second processing-circuit-side terminal, a second 90° hybrid coupler coupled to a third processing-circuit-side terminal and a fourth processing-circuit-side terminal, a third 90° hybrid coupler coupled to a first antenna-side terminal and a third antenna-side terminal, a fourth 90° hybrid coupler coupled to a second antenna-side terminal and a fourth antenna-side terminal, a first 90° delay circuit provided between the first 90° hybrid coupler and the third 90° hybrid coupler, and a second 90° delay circuit provided between the first 90° hybrid coupler and the fourth 90° hybrid coupler, in which the second 90° hybrid coupler is directly coupled to the third and fourth 90° hybrid couplers, and the respective antennas are coupled to the first to fourth antenna-side terminals of each of the Butler matrix circuits.

In addition, according to the present disclosure, there is provided a front-end module including: a Butler matrix circuit; an array antenna including a plurality of antennas; and a processing circuit including a switch circuit, which are stacked on each other, in which the Butler matrix circuit includes four processing-circuit-side terminals, four antenna-side terminals, a first 90° hybrid coupler coupled to a first processing-circuit-side terminal and a second processing-circuit-side terminal, a second 90° hybrid coupler coupled to a third processing-circuit-side terminal and a fourth processing-circuit-side terminal, a third 90° hybrid coupler coupled to a first antenna-side terminal and a third antenna-side terminal, a fourth 90° hybrid coupler coupled to a second antenna-side terminal and a fourth antenna-side terminal, a first 90° delay circuit provided between the first 90° hybrid coupler and the third 90° hybrid coupler, and a second 90° delay circuit provided between the first 90° hybrid coupler and the fourth 90° hybrid coupler, in which the second 90° hybrid coupler is directly coupled to the third and fourth 90° hybrid couplers.

Further, according to the present disclosure, there is provided a wireless communication terminal mounted with the Butler matrix circuit.

Effect of the Invention

As described above, according to the present disclosure, it is possible to provide the Butler matrix circuit, the phased array antenna, the front-end module, and the wireless communication terminal that make it possible to further reduce the volume and power consumption as well as to achieve symmetrical radiation characteristics.

It is to be noted that the above-described effects are not necessarily limitative, and any of the effects set forth in the present specification or other effects that can be grasped from the present specification may be achieved in addition to or in place of the above-described effects.

MODES FOR CARRYING OUT THE INVENTION

Figure 1:
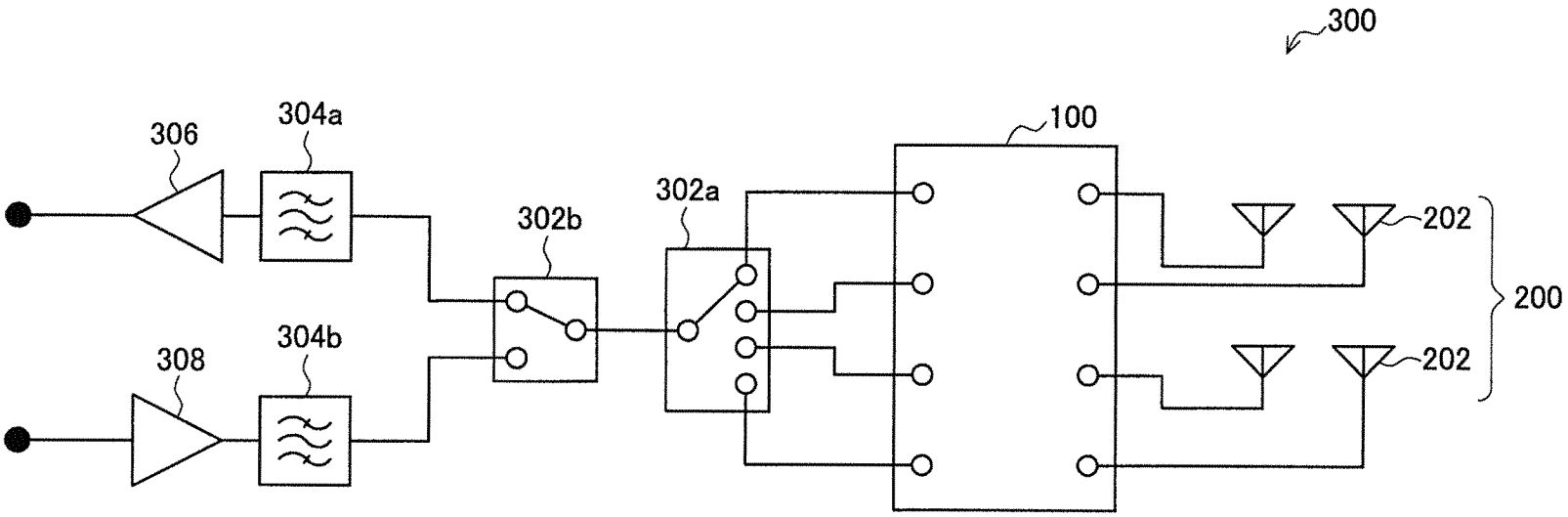
FIG. 1 is a circuit diagram schematically illustrating a configuration example of a front-end block 300 according to a first embodiment of the present disclosure.

Hereinafter, description is given in detail of preferred embodiments of the present disclosure with reference to the accompanying drawings. It is to be noted that, in the present specification and drawings, repeated description is omitted for components substantially having the same functional configuration by assigning the same reference numerals.

In addition, there is a case where, in the present specification and drawings, components having substantially the same or similar functional configuration may be denoted with the same reference numerals followed by different numerals to distinguish the components. However, in a case where it is unnecessary to particularly distinguish among components having substantially the same or similar functional configuration, only the same reference numerals are assigned. In addition, there is a case where similar components of different embodiments may be denoted with the same reference numerals followed by different alphabets to distinguish the components. However, in a case where it is unnecessary to particularly distinguish among the components having a similar functional configuration, only the same reference numerals are assigned.

In addition, the drawings to be referred to in the following descriptions are those for describing and facilitating understanding of an embodiment of the present disclosure; the shapes, dimensions, ratios, and the like illustrated in the drawings may differ from actual ones for the sake of clarity. Further, a circuit and the like illustrated in the drawings can be appropriately modified in design by referring to the following description and known techniques.

In the following description, expressions of shapes of electrodes and the like on stacked layers configuring a module do not mean only geometrically defined shapes, but also includes those in a case where there are allowable degree of differences and the like in securing characteristics of an antenna and the like as well as shapes similar to such shapes.

Further, in the following description of a circuit configuration, "coupling" means electrical coupling between a plurality of elements unless otherwise specified. Further, "coupling" in the following description includes not only a case of directly and electrically coupling a plurality of elements, but also a case of indirectly coupling the plurality of elements via another element.

It is to be noted that description is given in the following order.

1. Background in which Present Inventor has Created Embodiments according to Present Disclosure
1.1 Phased Array Antenna
1.2 Butler Matrix Circuit according to Comparative Example
2. First Embodiment
2.1 Front-End Block
2.2 Butler Matrix Circuit
2.3 Phased Array Antenna
2.4 Radiation Characteristics
3. Second Embodiment
3.1 Front-End Module
3.2 Power Feeding Method
4. Third Embodiment
5. Fourth Embodiment
6. Application Examples
6.1 Wireless Communication
6.1.1. Application Example of Control Entity
6.1.2. Application Example of Base Station
6.1.3. Application Examples of Mobile Terminal
6.2 Vehicle Control System
7. Conclusion
8. Supplement

Background in which Present Inventor has Created Embodiments According to Present Disclosure Description is given next of a background in which the present inventor has created the embodiments according to the present disclosure, before describing details of the embodiments according to the present disclosure.

1.1 Phased Array Antenna

As described earlier, in a fifth-generation mobile communication system, it is planned to use a millimeter wave band signal having a frequency of about several tens of GHz in order to improve a transmission rate significantly. The millimeter wave band signal has high rectilinearity (thus, high directivity) and large spatial attenuation, therefore, it has been considered to apply, to a mobile terminal, a phased array antenna which has been heretofore used mainly in a base station, in order to obtain a necessary antenna gain.

The phased array antenna includes a plurality of antennas; by controlling a phase difference between the antennas, it is possible to change directivity of the phased array antenna. Accordingly, it is possible for the phased array antenna to efficiently capture a signal from a specific direction and efficiently radiate the signal in a specific direction even when the signal is a millimeter wave band signal having large spatial attenuation, thus making it possible to secure a necessary antenna gain.

It is common to use, as a phase circuit which is one of components of the phased array antenna, a phase shifter (phase shifter), including a circuit and a control device, that controls a phase by switching delay lines and capacitances. For example, in a case where the phase shifter is used, it is necessary to provide a phase shifter or a driver circuit for controlling the phase shifter, for each of the antennas included in the phased array antenna. Accordingly, in this case, it is difficult to avoid an increase in circuit scale of a block of the phased array antenna.

Incidentally, as described earlier, the mobile terminal is requested to further reduce the volume and power consumption in order to ensure its portability, and thus it is also requested to further reduce the volume and power consumption also for the phased array antenna to be mounted on the mobile terminal. Accordingly, in such a circumstance, it is not preferable to increase the circuit scale of the block of the phased array antenna.

In view of such a circumstance, the present inventor has conceived of using a Butler matrix circuit in which 90° hybrid couplers are combined, as a phase shift circuit to be used in the phased array antenna. The Butler matrix circuit is a circuit that is able to output signals having phase differences at predetermined intervals to a plurality of output-side ports by switching input-side ports, and is a circuit having both functions of a divider and a phase shifter. The Butler matrix circuit is a passive circuit, and is able to implement a phase shift circuit for the phased array antenna by being combined with a switch for switching among input ports. Accordingly, the use of the Butler matrix circuit is beneficial in attempting to achieve reduced size and lower power consumption of the phased array antenna.

1.2 Butler Matrix Circuit According to Comparative Example

Figures 22, 23:
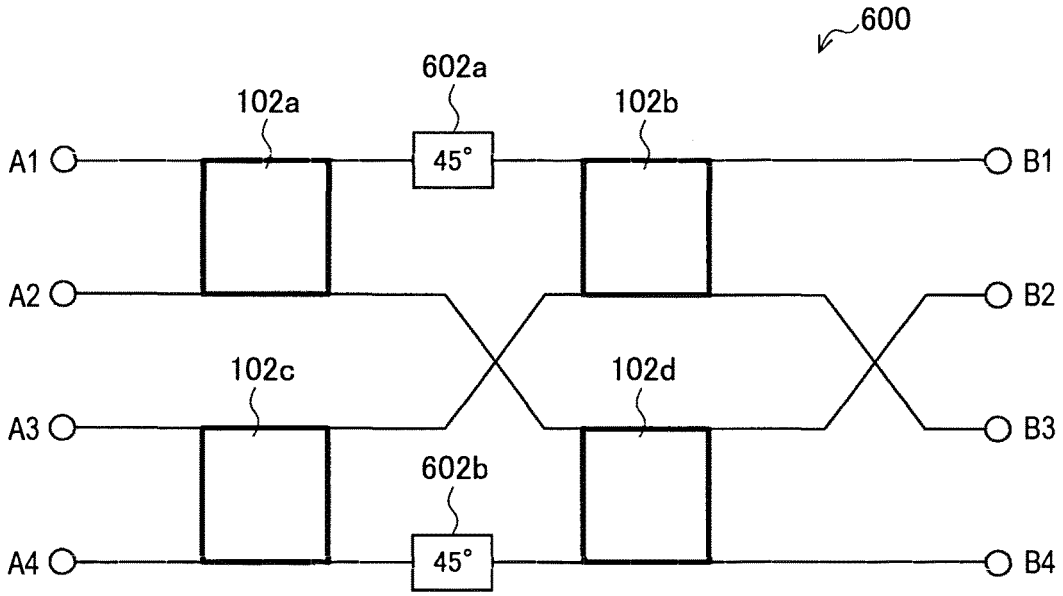
FIG. 22 is a configuration diagram of a Butler matrix circuit 600 according to a comparative example.
FIG. 23 is an explanatory diagram that describes an example of phases of signals to be outputted to respective output ports of the Butler matrix circuit 600 according to the comparative example.
Figure 24:
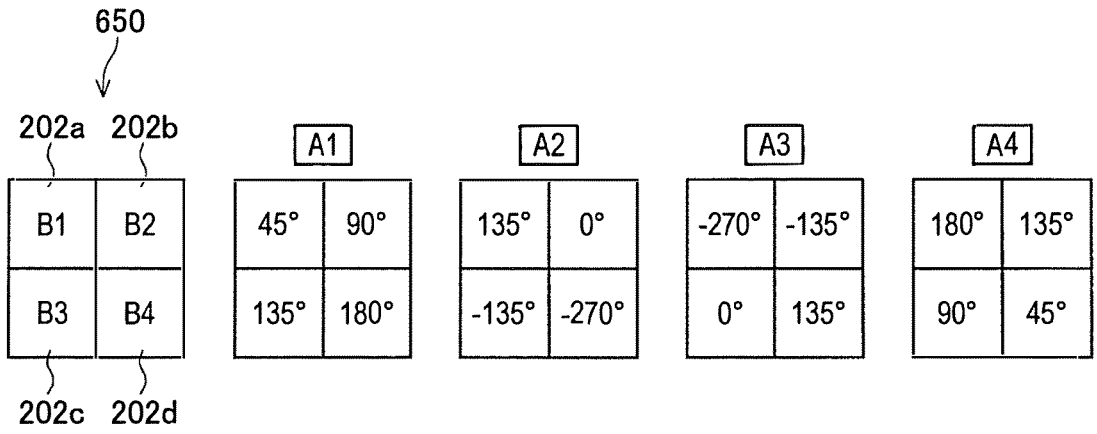
FIG. 24 is an explanatory diagram that describes an example of phases of signals to be outputted to the phased array antenna 650 to which the Butler matrix circuit 600 according to the comparative example is applied.
Figure 25:
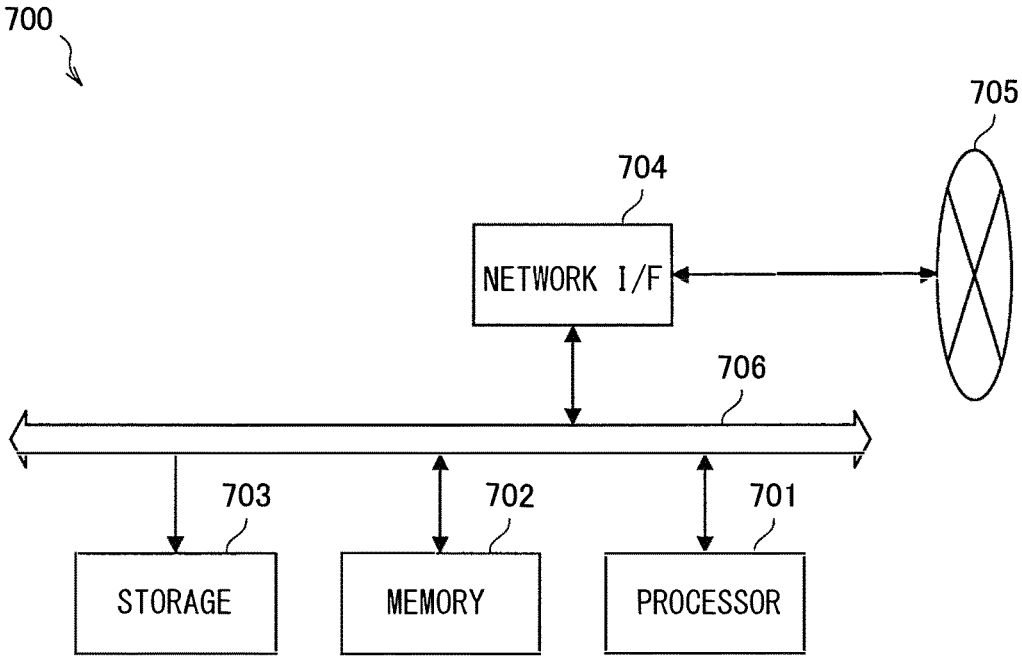
FIG. 25 is a block diagram illustrating an example of a schematic configuration of a server 700.

On the basis of the above-described conception, the present inventor has intensively studied the Butler matrix circuit to be applied to the phased array antenna to be mounted on a mobile terminal. Hereinafter, description is given, with reference to FIGS. 22 to 24, of a Butler matrix circuit 600 according to a comparative example that the present inventor has studied. FIG. 23 is a configuration diagram of the Butler matrix circuit 600 according to the comparative example. FIG. 24 is an explanatory diagram that describes an example of phases of signals to be outputted to respective output ports of the Butler matrix circuit 600 according to the comparative example, and FIG. 25 is an explanatory diagram that describes an example of phases of signals to be outputted to a phased array antenna 650 to which the Butler matrix circuit 600 according to the comparative example is applied. It is to be noted that, as used herein, the comparative example means the Butler matrix circuit 600 that the present inventor had been studying intensively until the embodiments of the present disclosure were created.

As illustrated in FIG. 22, the Butler matrix circuit 600 according to the comparative example includes four input ports A1 to A4, four output ports B10 to B4, four 90° hybrid couplers 102*a* to 102*d*, and two 45° delay circuits 602*a* and 602*b*. Particularly, the 90° hybrid coupler 102*a*, the 45° delay circuit 602*a*, and the 90° hybrid coupler 102*b* are provided between the input port A1 and the output port B1. The 90° hybrid coupler 102*a* and the 90° hybrid coupler 102*d* are provided between the input port A2 and the output port B2. The 90° hybrid coupler 102*c* and the 90° hybrid coupler 102*b* are provided between the input port A3 and the output port B3. Further, the 90° hybrid coupler 102*c*, the 45° delay circuit 602*b*, and the 90° hybrid coupler 102*d* are provided between the input port A4 and the output port B4.

The two 45° delay circuits 602*a* and 602*b* are each a circuit that delays a phase of an inputted signal by 45°. In addition, the 90° hybrid couplers 102*a* to 102*d* each have two input-side ports and two output-side ports, although the detailed configurations of the 90° hybrid couplers 102*a* to 102*d* are described later. In the 90° hybrid coupler 102, a signal inputted to one input-side port is equally distributed to two output-side ports (i.e., power of an output signal at each output-side port is ½ power of the input signal). Further, in the 90° hybrid coupler 102, the output signal at one output-side port is outputted with a phase shift of 90° with respect to the input signal. In addition, the output signal at the other output port is outputted with a phase shift of 90° with respect to the output signal at the one output port.

In such a Butler matrix circuit 600 according to the comparative example, phases of signals to be outputted to the respective output ports B1 to B4 have values as illustrated in FIG. 23. Specifically, in a case where an input signal is inputted to the input port A1 of the Butler matrix circuit 600, the phases of the output signals to be outputted from the output ports B1 to B4 are, respectively, 45°, 90°, 135°, and 180°. In a case where an input signal is inputted to the input port A2 of the Butler matrix circuit 600, the phases of the output signals to be outputted from the output ports B1 to B4 are, respectively, 135°, 0°, −135°, and −270°. That is, as appreciated from FIG. 23, in the Butler matrix circuit 600 according to the comparative example, phase differences between the output signals simultaneously outputted from the respective output ports B1 to B4 have an equal interval. Further, in the Butler matrix circuit 600 according to the comparative example, four distributed output signals having phase differences of ±45° or ±135° are outputted from the output ports B1 to B4 in accordance with the input ports A1 to A4 to which input signals are inputted.

However, the present inventor has repeatedly studied and has found that it is not possible to obtain symmetrical radiation characteristics in a case where the Butler matrix circuit 600 according to the comparative example is applied to the phased array antenna 650 in two rows and two columns. Particularly, the Butler matrix circuit 600 according to the comparative example shifts the phases of the output signals at the respective output ports B1 to B4 at an equal interval, and is therefore effective for a phased array antenna having antennas arranged in a row. However, it has been appreciated that it may not be possible to obtain the symmetrical radiation characteristics in some occasions, in a case where the Butler matrix circuit 600 according to the comparative example is applied to the phased array antenna 650 including a plurality of antennas arranged in a plurality of rows and a plurality of columns, such as two rows and two columns.

Now, consider, for example, a case of applying the Butler matrix circuit 600 according to the comparative example to the phased array antenna 650 in which four antennas 202*a* to 202*d* are arranged in two rows and two columns as illustrated on left side of FIG. 24. It is to be noted that, in the phased array antenna 650, as illustrated on the left side of FIG. 24, it is assumed that the antenna 202*a* located at the upper left is coupled to the output port B1 of the Butler matrix circuit 600, and that the antenna 202*b* located at the upper right is coupled to the output port B2. Further, in the phased array antenna 650, it is assumed that the antenna 202*c* located at the lower left is coupled to the output port B3, and that the antenna 202*d* located at the lower right is coupled to the output port B4.

In such a phased array antenna 650, phases of signals to be outputted to the antennas 202*a* to 202*d* have values as illustrated in FIG. 24. Specifically, in a case where a signal is inputted to the input port A1 of the Butler matrix circuit 600, output signals to be outputted from the respective antennas 202*a* to 202*d* at the upper left, upper right, lower left, and lower right are 45°, 90°, 135°, and 180°, respectively, as illustrated in the second from the left in FIG. 24. In addition, in a case where a signal is inputted to the input port A2 of the Butler matrix circuit 600, output signals to be outputted from the respective antennas 202*a* to 202*d* at the upper left, upper right, lower left, and lower right are 135°, 0°, −135°, and −270°, respectively, as illustrated in the third from the left in FIG. 24.

That is, in a case where the Butler matrix circuit 600 according to the comparative example is applied to the phased array antenna 650 in which the four antennas 202*a* to 202*d* are arranged in two rows and two columns, the phase changes in both the row direction and the column direction in the four antennas 202*a* to 202*d*, and a phase difference between the adjacent antennas 202 changes between 45° and 135°. As a result, in the phased array antenna 650, a radiation angle of the phased array antenna 650 ends up being changed simultaneously in a horizontal axis direction and a vertical axis direction by switching among the input ports A1 to A4 to which input signals are inputted. Accordingly, in such a case, the radiation characteristics that are able to be covered by the phased array antenna 650 by switching among the input ports A1 to A4 are not uniform, i.e., asymmetric; it is not possible to avoid generation of a region in which the radiation characteristics are weak. It is to be noted that details of the radiation characteristics according to the comparative example are described later together with comparison with radiation characteristics of the embodiments of the present disclosure.

In order to avoid the above-described phenomena, it is conceivable to control the radiation angle of the phased array antenna 650 in the vertical axis direction and the horizontal axis direction independently of each other. However, in order to perform such control, it is necessary to add a switching mechanism such as a switch to blocks of the phased array antenna 650; as a result, the circuit scale of the block of the phased array antenna 650 becomes large.

Therefore, on the basis of the above-described consideration, the present inventor has created a Butler matrix circuit that makes it possible to further reduce volume and power consumption of the blocks of the phased array antenna as well as to cause the phased array antenna to obtain the symmetrical radiation characteristics. Hereinafter, details of the Butler matrix circuit according to an embodiment of the present disclosure created by the present inventor are described sequentially.

2. First Embodiment

<2.1 Front-End Block>

First, description is given of a front-end block 300 according to an embodiment of the present disclosure with reference to FIG. 1. FIG. 1 is a circuit diagram schematically illustrating a configuration example of the front-end block 300 according to a first embodiment of the present disclosure. The front-end block 300 is mounted in a mobile terminal (illustration omitted) or the like, and is able to receive a signal and output the signal to an internal processing circuit section (illustration omitted), or to transmit a signal from the processing circuit section to the outside.

As illustrated in FIG. 1, the front-end block 300 according to the present embodiment includes a Butler matrix circuit 100 described later, a phased array antenna 200 including a plurality of antennas 202, switches (switch circuits) 302*a* and 302*b* that switch signal paths, filters 304*a* and 304*b* that remove a noise signal, an LNA (Low Noise Amplifier) (a processing circuit) 306, and a PA (Power Amplifier) (a processing circuit) 308. It is to be noted that, the front-end block 300 according to the present embodiment may not necessarily include all the elements illustrated in FIG. 1, and it is sufficient to include at least the Butler matrix circuit 100 and the phased array antenna 200. In addition, details of the Butler matrix circuit 100 and the phased array antenna 200 included in the front-end block 300 are described later.

Particularly, the switch 302*a* is coupled to inputs ports of the Butler matrix circuit 100. The switch 302*a* is a switch that switches the input ports of the Butler matrix circuit 100, includes, for example, a single-pole four-throw (SP4T) switch, and is able to switch directivity (beam direction) of the phased array antenna 200. In addition, the switch 302*b* coupled to the switch 302*a* is a switch that switches input/output signals, and includes, for example, a single-pole double-throw (SPDT) switch.

Signals received by the phased array antenna 200 pass through the Butler matrix circuit 100, the switch 302*a*, the switch 302*b*, and the filter 304*a*, and are amplified by the LNA 306 coupled to the filter 304*a*. Further, the amplified signals are processed by a processing circuit unit (illustration omitted) inside the mobile terminal.

Meanwhile, signals outputted from the processing circuit unit (illustration omitted) inside the mobile terminal are amplified by the PA 308, pass through the filter 304*b*, the switch 302*b*, the switch 302*a*, and the Butler matrix circuit 100, and are radiated from the phased array antenna 200. Further, the radiated signals are received by a base station (illustration omitted).

It is to be noted that, the Butler matrix circuit 100 according to the present embodiment is able to be configured by transmission lines as described later, and thus has smaller transmission loss as compared with a case where a component such as a phase shifter (phase shifter) is used. Accordingly, it is possible, in the phased array antenna 200 using the Butler matrix circuit 100, to output a high-power signal effectively from the phased array antenna 200, and thus to transmit the high-power signal to the above-mentioned processing circuit unit. As a result, even the above-mentioned the LNA 306 and the PA 308 having low characteristics can be tolerated and used, and costs of these components are expected to be lowered, thus making it possible to suppress an increase in manufacturing costs of the front-end block 300.

<2.2 Butler Matrix Circuit>

Figure 2:
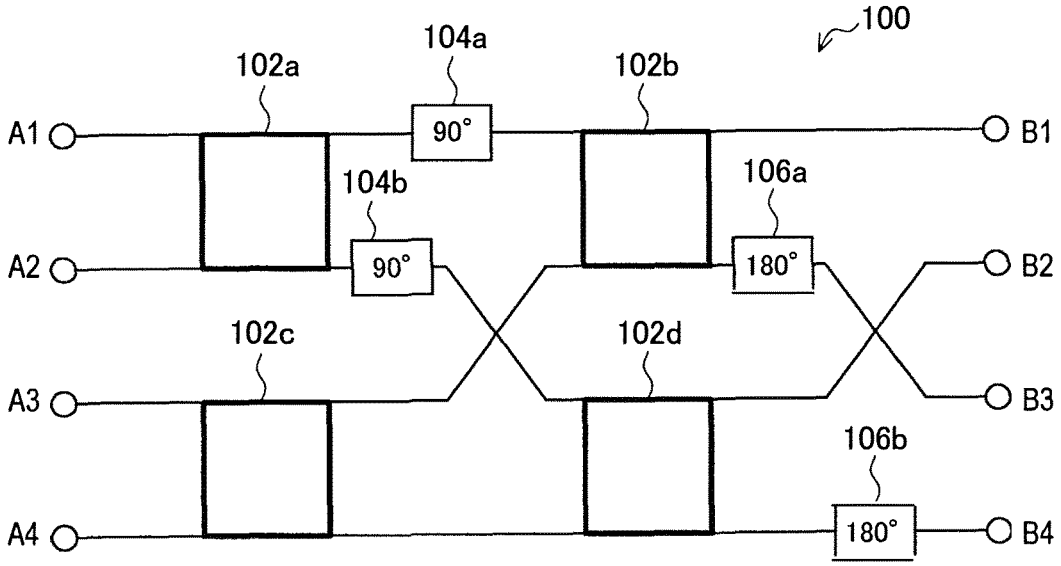
FIG. 2 is a configuration diagram of a Butler matrix circuit 100 according to the same embodiment.
Figure 3:
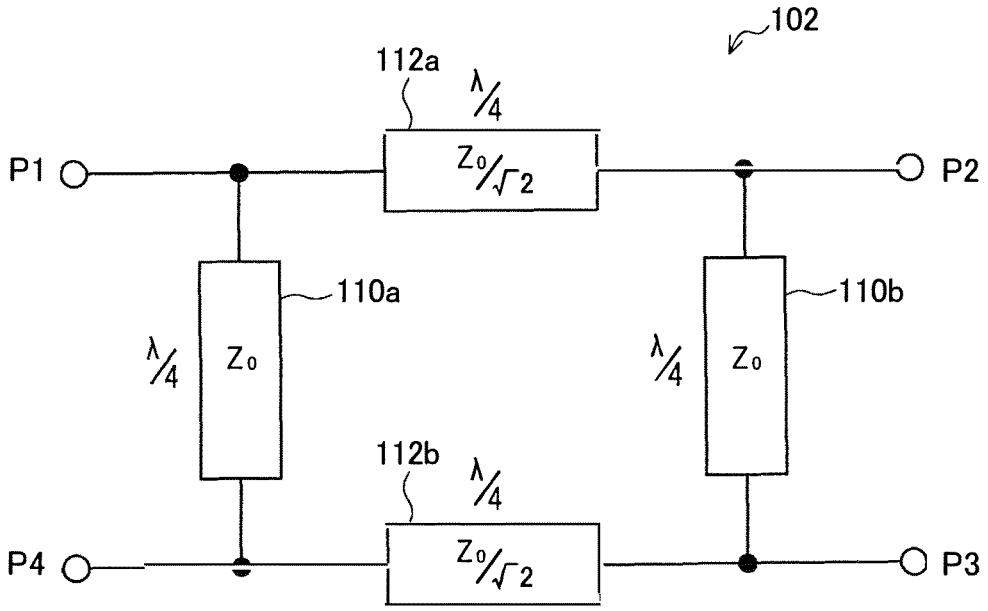
FIG. 3 is a configuration diagram of a 90° hybrid coupler 102.
Figures 4, 5:
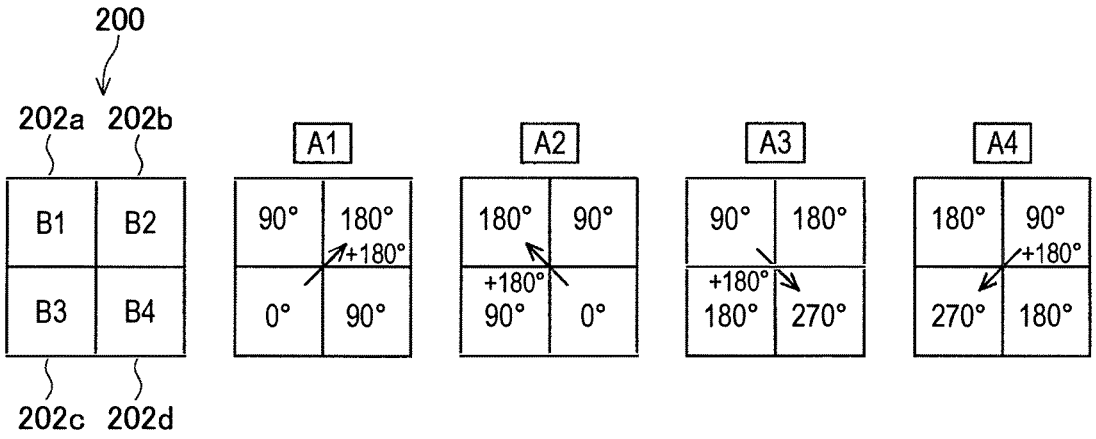
FIG. 4 is an explanatory diagram that describes an example of phases of signals to be outputted to respective output ports of the Butler matrix circuit 100 according to the same embodiment.
FIG. 5 is an explanatory diagram that describes an example of phases of signals to be outputted to a phased array antenna 200 to which the Butler matrix circuit 100 according to the same embodiment is applied

Next, description is given of the Butler matrix circuit according to the present embodiment with reference to FIGS. 2 to 4. FIG. 2 is a configuration diagram of the Butler matrix circuit 100 according to the present embodiment. FIG. 3 is a configuration diagram of a 90° hybrid coupler 102. FIG. 4 is an explanatory diagram that describes an example of phases of signals to be outputted to respective output ports of the Butler matrix circuit 100 according to the embodiment.

As illustrated in FIG. 2, the Butler matrix circuit 100 according to the present embodiment includes four input ports (processing-circuit-side terminals) A1 to A4, four output ports (antenna-side terminals) B1 to B4, four 90° hybrid couplers 102*a* to 102*d*, two 90° delay circuits 104*a* and 104*b*, and two 180° delay circuits 106*a* and 106*b*.

Particularly, in the Butler matrix circuit 100, the 90° hybrid coupler 102*a* (a first 90° hybrid coupler) is coupled to the input ports A1 and A2 (first and second processing-circuit-side terminals); the 90° hybrid coupler 102*c* (a second 90° hybrid coupler) is coupled to the input ports A3 and A4 (third and fourth processing-circuit-side terminals); the 90° hybrid coupler 102*b* (a third 90° hybrid coupler) is coupled to the output ports B1 and B3 (first and third antenna-side terminals); and the 90° hybrid coupler 102*d* (a fourth 90° hybrid coupler) is coupled to the output ports B2 and B4 (second and fourth antenna-side terminals). Further, in the Butler matrix circuit 100, a 90° delay circuit 104*a* (a first 90° delay circuit) is provided between the 90° hybrid coupler 102*a* and the 90° hybrid coupler 102*b*, and a 90° delay circuit 104*b* (a second 90° delay circuit) is provided between the 90° hybrid coupler 102*a* and the 90° hybrid coupler 102*d*. In addition, in the Butler matrix circuit 100, a 180° delay circuit 106*a* (a first 180° delay circuit) is provided between the 90° hybrid coupler 102*b* and the output port B3, and a 180° delay circuit 106*b* (a second 180° delay circuit) is provided between the 90° hybrid coupler 102*d* and the output port B4. In addition, the 90° hybrid coupler 102*c* is directly coupled to the 90° hybrid coupler 102*b* and the 90° hybrid coupler 102*d*.

It is to be noted that, as described later, the present embodiment is not limited to providing the 180° delay circuit 106*a* between the 90° hybrid coupler 102*b* and the output port B3 and to providing the 180° delay circuit 106*b* between the 90° hybrid coupler 102*d* and the output port B4. For example, in the present embodiment, in a case of providing an element that functions similarly to the 180° delay circuits 106*a* and 106*b*, the 180° delay circuit 106*b* may not be necessarily provided. In addition, in the present embodiment, the 180° delay circuits 106*a* and 106*b* may be provided, respectively, between the 90° hybrid coupler 102*b* and the output port B1 and between the 90° hybrid coupler 102*d* and the output port B2, instead of, respectively, between the 90° hybrid coupler 102*b* and the output port B3 and between the 90° hybrid coupler 102*d* and the output port B4.

The two 90° delay circuits 104*a* and 104*b* are each a circuit that delays a phase of an inputted input signal by 90°. In addition, the two 180° delay circuits 106*a* and 106*b* are each a circuit that delays a phase of an inputted input signal by 180°. The delay circuits 104*a*, 104*b*, 106*a*, and 106*b* may be, for example, electronic components or transmission lines each having a predetermined length (electric length).

Next, description is given of the above-mentioned 90° hybrid couplers 102*a* to 102*d* with reference to FIG. 3. As illustrated in FIG. 3, the 90° hybrid coupler 102 includes four ports P1 to P4, transmission lines 110*a* and 110*b* having an impedance of $Z_0$ (e.g., impedance $Z_0$ of 50Ω), and transmission lines 112*a* and 112*b* having an impedance of $Z_0/\sqrt{2}$. These ports P1 to P4 and transmission line 110*a*, 110*b*, 112*a*, and 112*b* are arranged and coupled in a symmetrical relationship as illustrated in FIG. 3. It is to be noted that, an electric length of each of these transmission lines 110*a*, 110*b*, 112*a*, and 112*b* is set to λ/4 (it is to be noted that let λ be a wavelength of a signal to be transmitted by the transmission lines 110*a*, 110*b*, 112*a*, and 112*b*).

In a case where an input signal is inputted to the port P1 of the 90° hybrid coupler 102, a signal is not outputted from the port P4, and an output signal having a power of ½ and a phase shift of 90° with respect to the input signal is outputted from the port P2. Further, an output signal having the same power and a phase shift of 90° with respect to the output signal at the port P2 is outputted from the port P3. In addition, in a case where an input signal is inputted to the port P4, a signal is not outputted from the port P1, and an output signal having a power of ½ and a phase shift of 90° with respect to the input signal is outputted from the port P3. Further, an output signal having the same power and a phase shift of 90° with respect to the output signal at the port P3 is outputted from the port P2.

In such a Butler matrix circuit 100 according to the present embodiment, phases of the signals to be outputted to the respective output ports B1 to B4 have values as illustrated in FIG. 4. Specifically, in a case where a signal is inputted to the input port A1 of the Butler matrix circuit 100, the phases of the output signals to be outputted from the output ports B1 to B4 are, respectively, 90°, 180°, 0°, and 90°. In addition, in a case where a signal is inputted to the input port A2 of the Butler matrix circuit 100, the phases of the output signals to be outputted from the output ports B1 to B4 are, respectively, 180°, 90°, 90°, and 0°. Accordingly, in the output ports B1 to B4 of the Butler matrix circuit 100 according to the present embodiment, two in-phase signals and signals having phase differences of +90° and −90° with respect to the signals form a combination, which produces a result different from the Butler matrix circuit 600 according to the comparative example described above.

It is to be noted that, as described earlier, the Butler matrix circuit 100 according to the present embodiment is a passive circuit, and is able to implement a phase shift circuit of the phased array antenna 200 described later, by being combined with a switch for switching among the input ports A1 to A4. Accordingly, in the present embodiment, the use of the Butler matrix circuit 100 described above allows for a simple configuration, thus making it possible to achieve reduced size and lower power consumption of the blocks of the phased array antenna 200.

In addition, the Butler matrix circuit 100 according to the present embodiment is able to be configured by transmission lines as described later, and thus has smaller transmission loss as compared with a case where a component such as a phase shifter is used. Accordingly, in the phased array antenna 200 using the Butler matrix circuit 100, eliminating the use of the component makes it possible not only to suppress an increase in manufacturing costs but also to effectively increase the signal output of the phased array antenna 200.

It is to be noted that, in the Butler matrix circuit 100 described above, the ports to which the input signals are inputted are set as the input ports A1 to A4, and the ports to which the output signals are outputted are set as the output ports B1 to B4, but the present embodiment is not limited thereto. Accordingly, in the Butler matrix circuit 100 according to the present embodiment, an input signal may be inputted to the output ports B1 to B4, and an output signal may be outputted from the input ports A1 to A4. In other words, in the Butler matrix circuit 100 according to the present embodiment, it can be said that the input ports A1 to A4 are ports arranged on side of the processing circuit and are to be coupled, whereas the output ports B1 to B4 are ports arranged on side of the phased array antenna 200 and are to be coupled.

<2.3 Phased Array Antenna>

Next, description is given, with reference to FIG. 5, of the phased array antenna 200 to which the Butler matrix circuit 100 according to the present embodiment is applied. FIG. 5 is an explanatory diagram that describes an example of phases of signals to be outputted to the phased array antenna 200 to which the Butler matrix circuit 100 according to the present embodiment is applied.

The phased array antenna 200 according to the present embodiment is, for example, a phased array antenna in which the four antennas 202*a* to 202*d* are arranged in two rows and two columns as illustrated on left side of FIG. 5. Particularly, it is assumed, in the phased array antenna 200, that, as illustrated on the left side of FIG. 5, the antenna 202*a* located at the upper left is coupled to the output port B1 of the Butler matrix circuit 100; the antenna 202*b* located at the upper right is coupled to the output port B2; the antenna 202*c* located on the lower left is coupled to the output port B3; and the antenna 202*d* located on the lower right is coupled to the output port B4.

In such a phased array antenna 200, phases of signals to be outputted to the respective antennas have values as illustrated in FIG. 5. Specifically, in a case where an input signal is inputted to the input port A1 of the Butler matrix circuit 100, the phases of the output signals to be outputted from the respective antennas 202*a* to 202*d* at the upper left, upper right, lower left, and lower right are, respectively, 90°, 180°, 0°, and 90°, as illustrated in the second from the left in FIG. 5. In addition, in a case where a signal is inputted to the input port A2 of the Butler matrix circuit 100, the phases of the output signals to be outputted from the respective antennas 202*a* to 202*d* at the upper left, upper right, lower left, and lower right are, respectively, 180°, 90°, 90°, and 0°, as illustrated in the third from the left in FIG. 5. It is to be noted that, the input ports A1 to A4 in a case where no input signals are inputted may be open or may be coupled to a ground potential.

As appreciated from FIG. 5, in the present embodiment, even in a case where an input signal is inputted to any of the input ports A1 to A4, the phases of the output signals to be outputted from the respective antennas 202*a* to 202*d* are sequentially shifted by 90°. Further, in the present embodiment, every time the input ports A1 to A4 to which the input signals are inputted are switched, directions (represented by arrows in the drawing) in which the phase relationship is shifted by 180° are switched to four directions, i.e., upper right, upper left, lower right, and lower left. Accordingly, the phased array antenna 200 according to the present embodiment is able to have directivity in four directions that are in a mutually symmetrical relationship.

<2.4 Radiation Characteristics>

Figure 6:
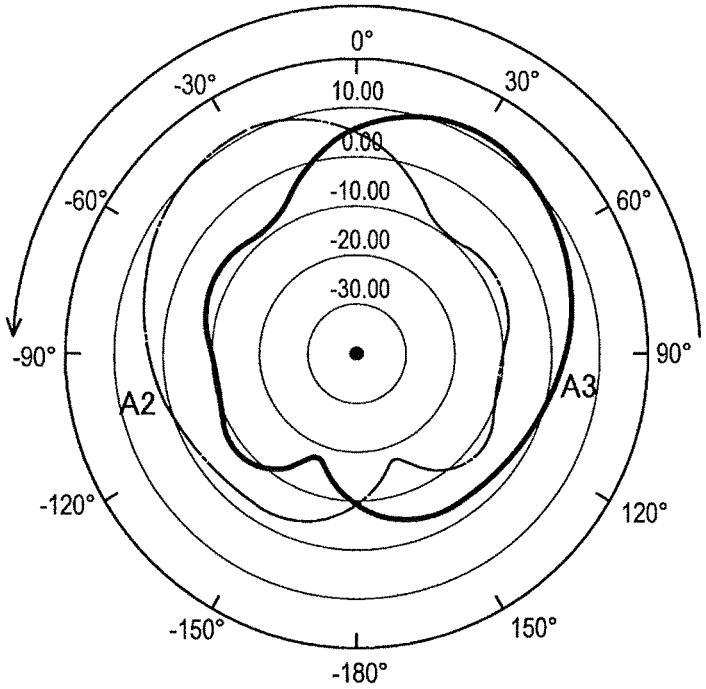
FIG. 6 illustrates simulation results of radiation characteristics in a case where input signals are inputted to input ports A2 and A3 in the phased array antenna 200 according to the same embodiment.
Figure 6:
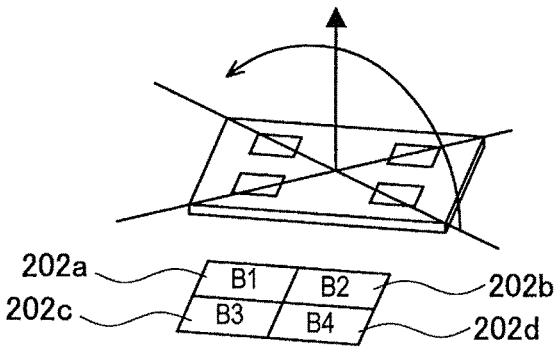
Figure 7:
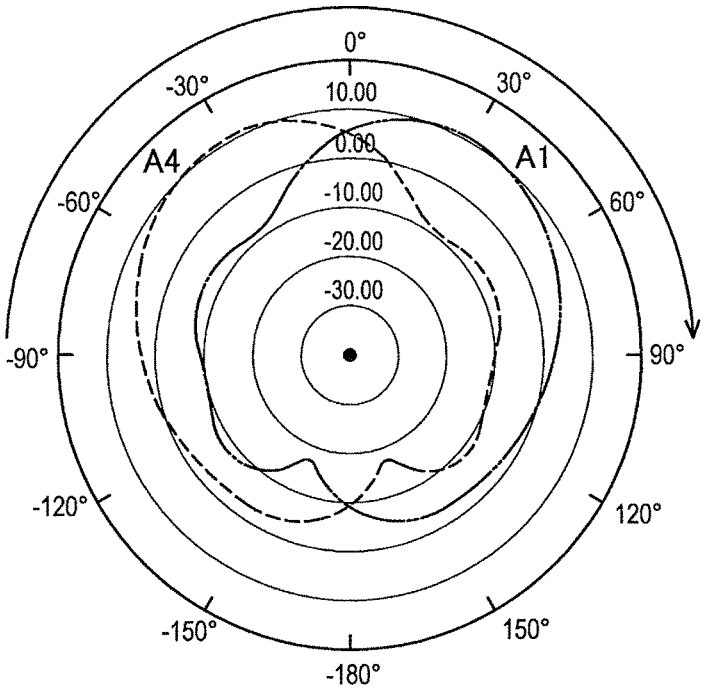
FIG. 7 illustrates simulation results of radiation characteristics in a case where input signals are inputted to input ports A1 and A4 in the phased array antenna 200 according to the same embodiment.
Figure 7:
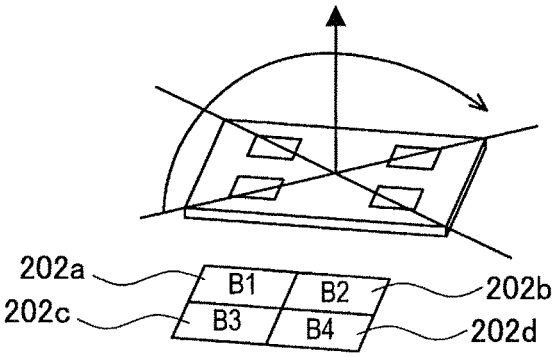

Next, description is given of simulation results of radiation characteristics in the above-described phased array antenna 200 according to the present embodiment with reference to FIGS. 6 and 7. FIG. 6 illustrates simulation results of radiation characteristics in a case where input signals are inputted to the input ports A2 and A3 in the phased array antenna 200 according to the present embodiment. In addition, FIG. 7 illustrates simulation results of radiation characteristics in a case where input signals are inputted to the input ports A1 and A4 in the phased array antenna 200 according to the present embodiment. It is to be noted that, FIGS. 6 and 7 each schematically illustrate, on lower side, positions of the respective antennas 202*a* to 202*d* in the phased array antenna 200, respective coupling relationships between the antennas 202*a* to 202*d* and the output ports B1 to B4, and a range of 90° to −90° in the simulation results of the radiation characteristics. Particularly, an arc-shaped arrow indicating the range of 90° to −90° in the simulation results of the radiation characteristics of each drawing corresponds to an arc-shaped arrow illustrated on lower side of the relevant drawing.

As illustrated in FIG. 6, in the phased array antenna 200 according to the present embodiment, in a case where an input signal of a predetermined frequency is inputted to the input port A2 and the input port A3, radiation patterns each have a peak in a direction of a diagonal line that connects the antenna 202*d* and the antenna 202*a*. In addition, as illustrated in FIG. 7, in the phased array antenna 200 according to the present embodiment, in a case where an input signal of a predetermined frequency is inputted to the input port A1 and the input port A4, the radiation patterns each have a peak in a direction of a diagonal line that connects the antenna 202*c* and the antenna 202*b*. That is, as appreciated from the simulation results, in a case where input signals are inputted to the respective input ports A1 to A4, it is possible, in the phased array antenna 200 according to the present embodiment, to obtain mutually symmetrical radiation characteristics with a peak in a diagonal direction of a substrate plane of the phased array antenna 200.

Figure 8:
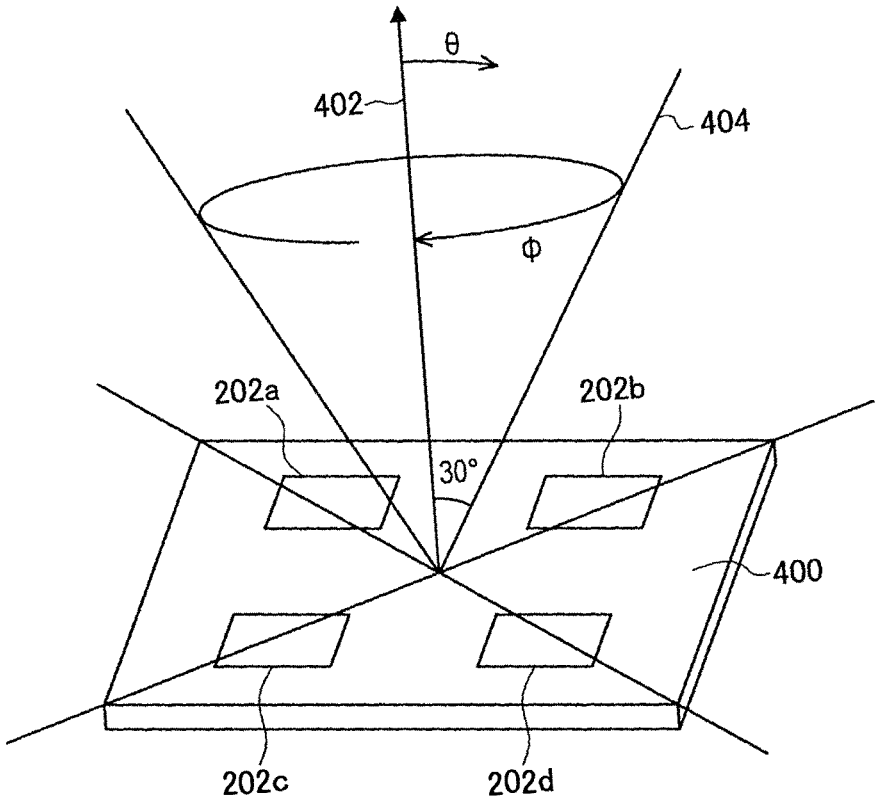
FIG. 8 is an explanatory diagram for describing simulation results of the radiation characteristics.
Figure 8:
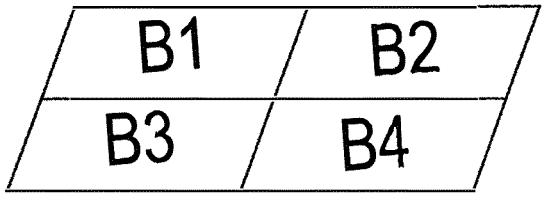
Figure 9:
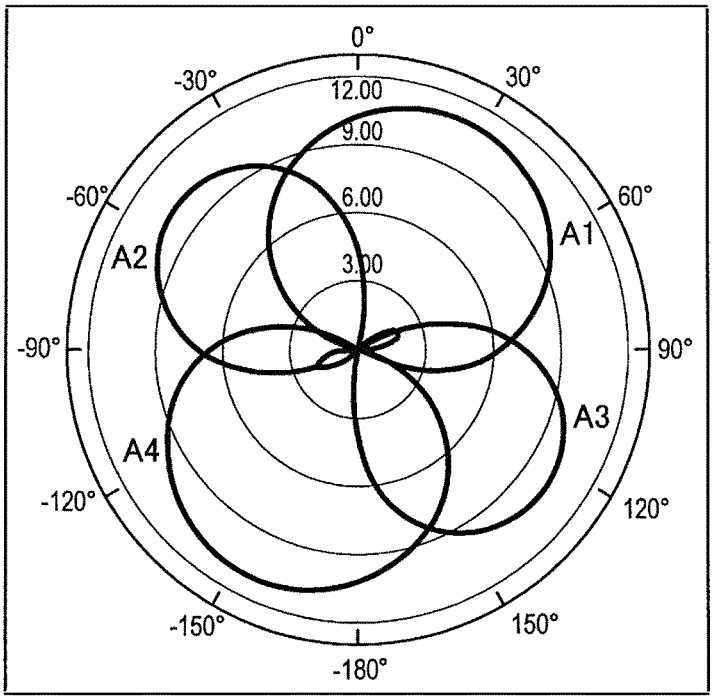
FIG. 9 illustrates simulation results of radiation characteristics on a circumference in Φ direction in a phased array antenna 650 according to a comparative example.
Figure 10:
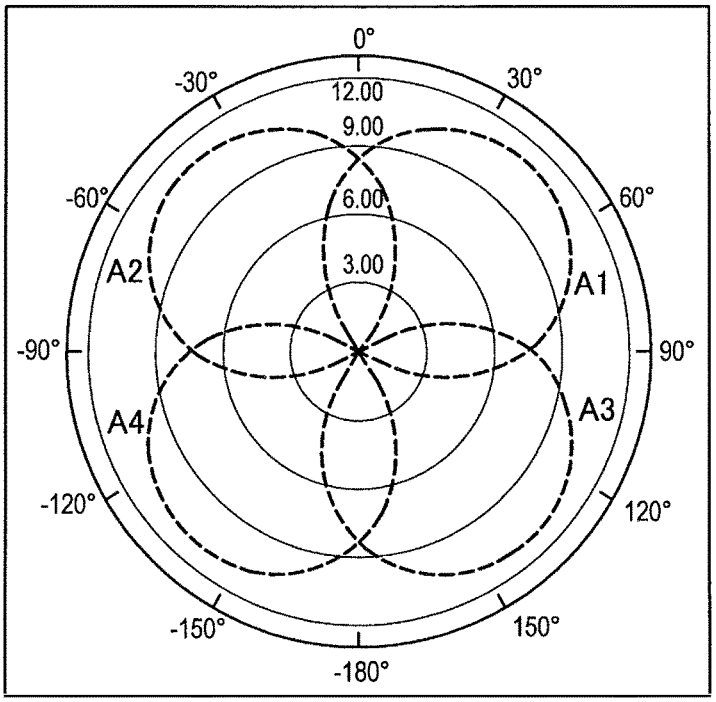
FIG. 10 illustrates simulation results of radiation characteristics on a circumference in the Φ direction in the phased array antenna 200 according to the same embodiment.
Figure 11:
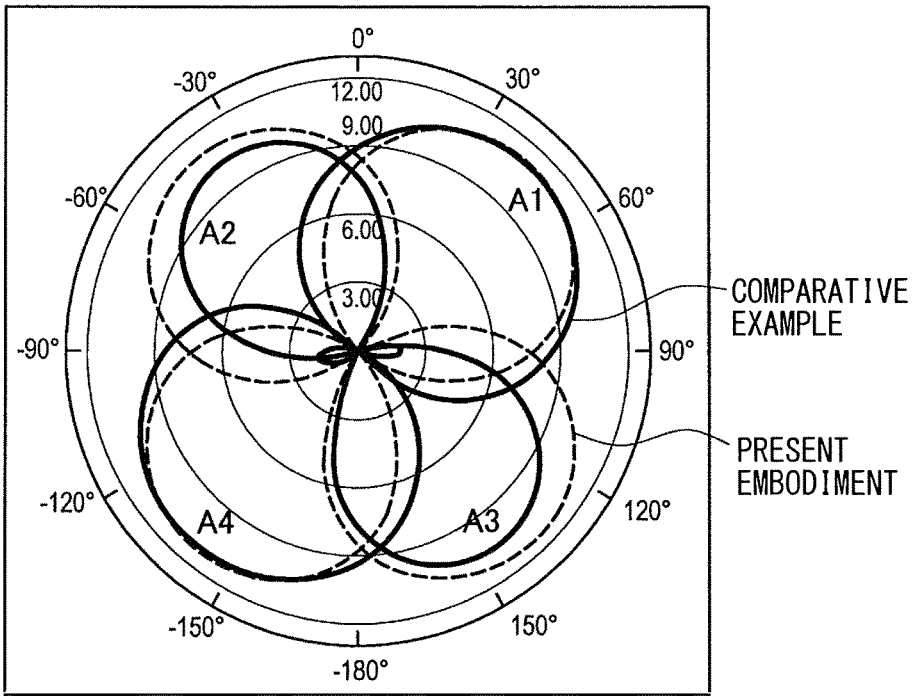
FIG. 11 is an explanatory diagram for describing comparison between the simulation results of the radiation characteristics of the phased array antenna 200 of the same embodiment and the phased array antenna 650 according to the comparative example.

Next, description is given, with reference to FIGS. 8 to 11, of simulation results of radiation characteristics on a circumference in a Φ direction in the phased array antenna 200 according to the present embodiment. FIG. 8 is an explanatory diagram that describes simulation results of the radiation characteristics. It is to be noted that, FIG. 8 schematically illustrates, on lower side, respective coupling relationships between the antennas 202*a* to 202*d* of the phased array antenna 200 and the output ports B1 to B4. FIG. 9 illustrates simulation results of radiation characteristics on the circumference in the Φ direction in the phased array antenna 650 according to the comparative example. FIG. 10 illustrates simulation results of radiation characteristics on the circumference in the Φ direction in the phased array antenna 200 according to the present embodiment. Further, FIG. 11 is an explanatory diagram for describing comparison between the simulation results of the radiation characteristics of the phased array antenna 200 of the present embodiment and the phased array antenna 650 according to the comparative example.

As illustrated in FIG. 8, the simulation results of the radiation characteristics described below corresponds to radiation characteristics on the circumference in the Φ direction obtained in a case where an axis 404 inclined by 30° (θ=30°) from a front direction (direction perpendicular to a plane) 402 of a substrate 400 of the phased array antenna is rotated about the front direction as a center axis.

First, description is given of the simulation results of the radiation characteristics on the circumference in the Φ direction in the phased array antenna 650 according to the comparative example illustrated in FIG. 9. As appreciated from FIG. 9, in the phased array antenna 650 according to the comparative example, in a case where an input signal of a predetermined frequency is inputted to the input port A2 and the input port A3, a length from the center to the peak extending diagonally is smaller as compared with a case where an input signal of a predetermined frequency is inputted to the input port A1 and the input port A4. That is, in the phased array antenna 650 according to the comparative example, in the case where an input signal of a predetermined frequency is inputted to the input port A2 and the input port A3, a signal to be radiated is weaker as compared with the case where an input signal of a predetermined frequency is inputted to the input port A1 and the input port A4.

Next, description is given of the simulation results of the radiation characteristics on the circumference in the Φ direction in the phased array antenna 200 according to the present embodiment illustrated in FIG. 10. As appreciated from FIG. 10, in the phased array antenna 200 according to the present embodiment, even in a case where an input signal of a predetermined frequency is inputted to any of the input ports A1 to A4, mutually symmetrical radiation characteristics are exhibited. That is, it has been appreciated, in the phased array antenna 200 according to the present embodiment, that favorable radiation characteristics that are symmetrical and uniform are obtained in all directions.

The phased array antenna 200 according to the present embodiment and the phased array antenna 650 according to the comparative example have different directions (angles) of the peaks of the radiation characteristics, and therefore the results of the respective radiation characteristics are illustrated, in FIG. 11, in an overlapped manner to match the directions of the peaks. In FIG. 11, the results of the comparative example are indicated by a solid line, whereas the results of the present embodiment are indicated by a broken line. As appreciated from FIG. 11, the phased array antenna 200 according to the present embodiment has improved radiation characteristics in a case where an input signal is inputted to the input port A2 and the input port A3, as compared with the comparative example.

As described above, according to the present embodiment, the use of the Butler matrix circuit 100 according to the present embodiment makes it possible to further reduce the volume and power consumption of the blocks of the phased array antenna 200 as well as to achieve the symmetrical radiation characteristics.

3. Second Embodiment

<3.1 Front-End Module>

Figure 12:
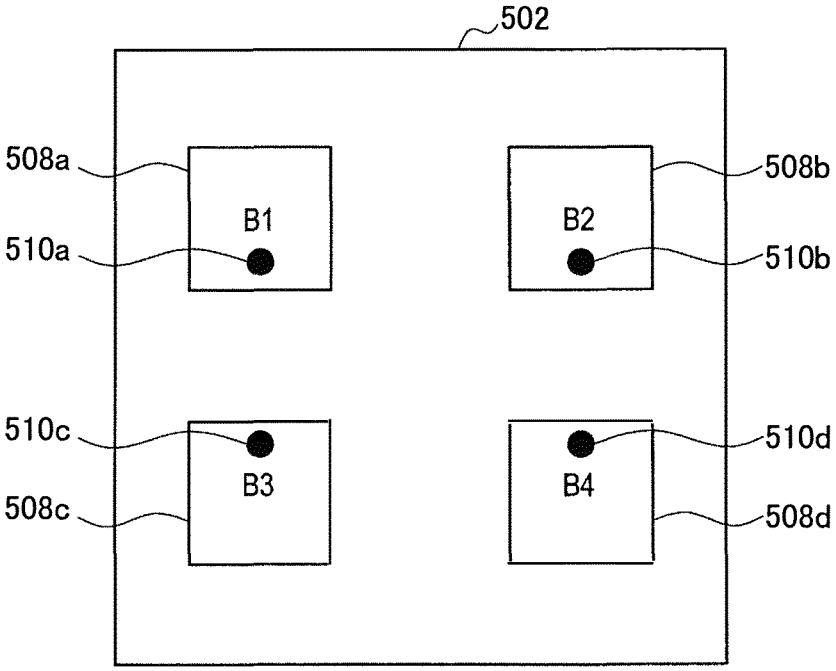
FIG. 12 is a layout diagram illustrating a configuration example of a first layer 502 of a front-end module 500 according to a second embodiment of the present disclosure.
Figure 13:
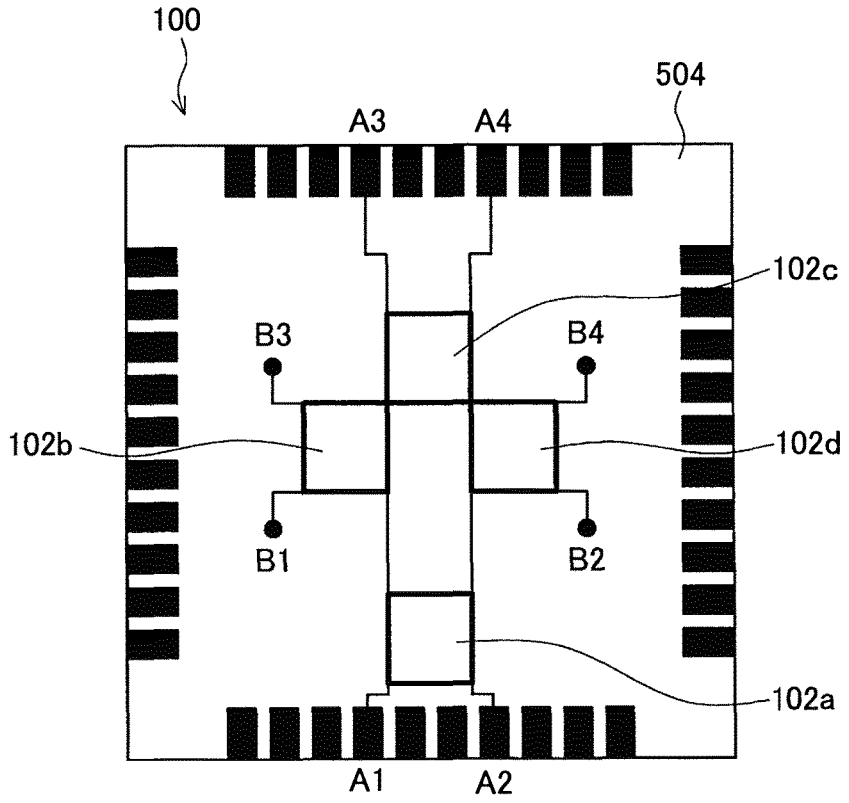
FIG. 13 is a layout diagram illustrating a configuration example of a second layer 504 of the front-end module 500 according to the same embodiment.
Figure 14:
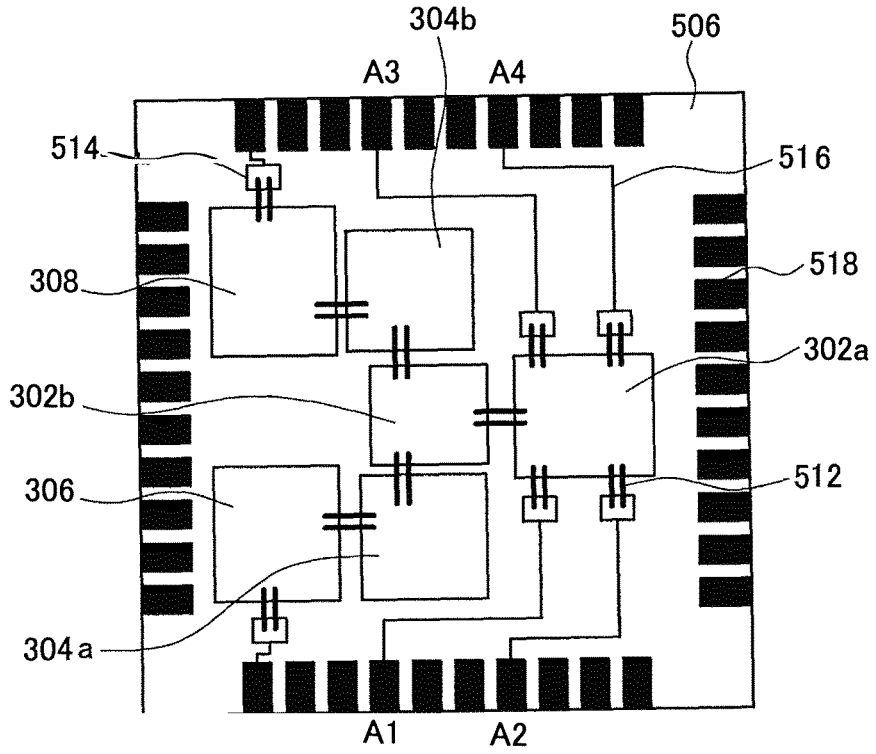
FIG. 14 is a layout diagram illustrating a configuration example of a third layer 506 of the front-end module 500 according to the same embodiment.
Figure 15:
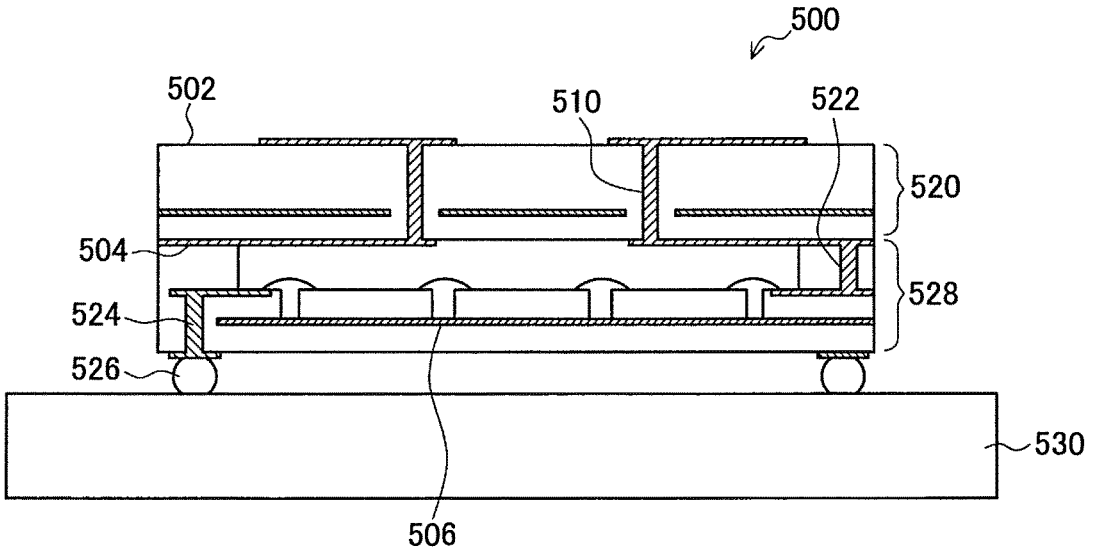
FIG. 15 is a cross-sectional view of a configuration example of the front-end module 500 according to the same embodiment.
Figure 16:
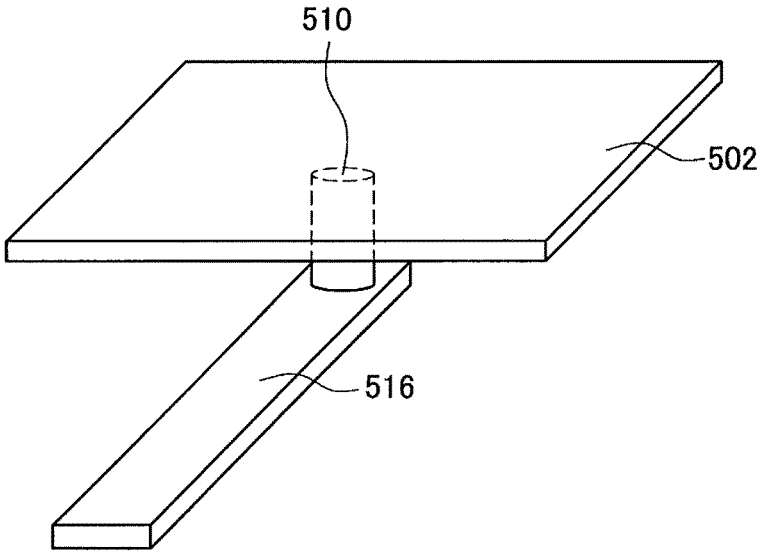
FIG. 16 is an explanatory diagram for describing a method of power feeding to a patch antenna 508 by a via 510 according to the same embodiment.
Figure 17:
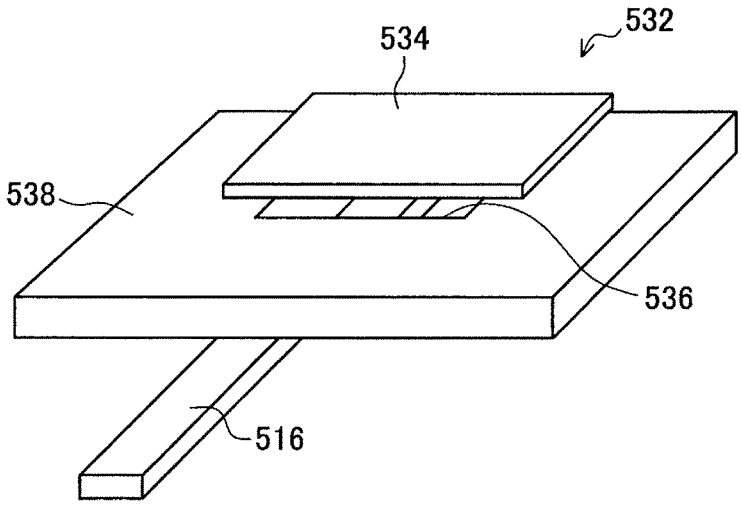
FIG. 17 is an explanatory diagram for describing a method of power feeding to the patch antenna 508 by a slot 532 according to the same embodiment.

Next, description is given, as a second embodiment of the present disclosure, of a configuration example of a front-end module 500 using the phased array antenna 200 according to the first embodiment of the present disclosure, with reference to FIGS. 12 to 17. FIG. 12 is a layout diagram illustrating a configuration example of a first layer 502 of the front-end module 500 according to the present embodiment; FIG. 13 is a layout diagram illustrating a configuration example of a second layer 504 of the front-end module 500 according to the present embodiment; and FIG. 14 is a layout diagram illustrating a configuration example of a third layer 506 of the front-end module 500 according to the present embodiment. FIG. 15 is a cross-sectional view of a configuration example of the front-end module 500 according to the present embodiment. FIG. 16 is an explanatory diagram for describing a method of power feeding to a patch antenna 508 by a via 510 according to the present embodiment. FIG. 17 is an explanatory diagram for describing a method of power feeding to the patch antenna 508 by a slot 532 according to the present embodiment.

As illustrated in FIG. 15 described later, the front-end module 500 according to the present embodiment is configured by stacking, on each other, three layers of the first to third layers 502, 504, and 506 illustrated in FIGS. 12 to 14. In addition, each of these layers 502, 504, and 506 is provided with an array antenna including a plurality of patch antennas (antennas) 508, the Butler matrix circuit 100 according to the present embodiment, and a processing circuit including a switch circuit and the like, as described later.

The layers 502, 504, and 506 each include a printed (PCB) substrate, a ceramic substrate, a silicon substrate, or a glass substrate in which wiring lines or the like are formed on a substrate including resin. It is to be noted that wavelength-shortening effects are expected in a high-dielectric substrate;

therefore the use of the high-dielectric substrate for the front-end module 500 according to the present embodiment makes it possible to reduce an area of the substrate and volume of the module. For example, in the present embodiment, it is possible to use a substrate having a relative permittivity of 7 to 9. In addition, a silicon substrate and a glass substrate each have high heat resistance and high hardness, thus making it possible to process a wiring line and the like by applying a semiconductor manufacturing process technique. Accordingly, use of a silicon substrate or a glass substrate for the front-end module 500 according to the present embodiment makes it possible to process a finer transmission line or the like with high accuracy.

First, as illustrated in FIG. 12, patch antennas 508*a* to 508*d* including four square-shaped electrodes are arranged in two rows and two columns on the first layer 502 including a square-shaped substrate. The patch antennas 508*a* to 508*d* have an identical shape and an identical size, and are arranged to be point-symmetrical about the center of the first layer 502 as a point of symmetry. It is to be noted that, in the present embodiment, the patch antennas 508*a* to 508*d* are, preferably, accurately arranged to be symmetrical to allow radiation characteristics of the front-end module 500 to be symmetrical and uniform.

In addition, the patch antennas 508*a* to 508*d* include vias 510*a* to 510*d*, respectively, coupled to the respective output ports B1 to B4 of the Butler matrix circuit 100 provided on the second layer 504 described later. Particularly, in FIG. 12, the patch antenna 508*a* (a first antenna) disposed in the first row and the first column is coupled to the output port B1 (a first antenna-side terminal) of the Butler matrix circuit 100, and the patch antenna 508*c* (a second antenna) disposed in the second row and the first column is coupled to the output port B3 (a third antenna-side terminal) of the Butler matrix circuit 100. Further, the patch antenna 508*b* (a third antenna) disposed in the first row and the second column is coupled to the output port B2 (a first antenna-side terminal) of the Butler matrix circuit 100, and the patch antenna 508*d* (a fourth antenna) disposed in the second row and the second column is coupled to the output port B4 (a fourth antenna-side terminal) of the Butler matrix circuit 100.

In addition, in FIG. 12, the vias 510*a* to 510*d* are provided to have a positional relationship of 180° inversion from each other in two of the patch antennas 508*a* to 508*d* arranged in an identical column. Providing the vias 510*a* to 510*d* in this manner allows the two of the patch antennas 508*a* to 508*d* disposed in the identical column have a shape of 180° inversion from each other. Specifically, the via 510*a* of the patch antenna 508*a* disposed in the first row and the first column and the via 510*c* of the patch antenna 508*c* disposed in the second row and the first column are arranged at positions having a positional relationship of 180° inversion from each other. In addition, the via 510*b* of the patch antenna 508*b* disposed in the first row and the second column and the via 510*d* of the patch antenna 508*d* disposed in the second row and the second column are arranged at positions having a positional relationship of 180° inversion from each other. In this manner, arranging the vias 510*a* to 510*d* allows transmission lines to the vias 510*a* to 510*d* in the Butler matrix circuit 100 to function as the 180° delay circuits 106*a* and 106*d* of the Butler matrix circuit 100.

It is to be noted that, in the present embodiment, the vias 510*a* to 510*d* are not limited to being provided as illustrated in FIG. 12; for example, the vias 510*a* to 510*d* may be provided to have a positional relationship of 180° inversion from each other in two of the patch antennas 508*a* to 508*d* arranged in an identical row. Alternatively, in the present embodiment, the vias 510*a* to 510*d* may be provided at an identical position in all of the patch antennas 508*a* to 508*d*. In the latter case, elements functioning as the 180° delay circuits 106*a* and 106*d* may be provided in the Butler matrix circuit 100 provided on the second layer 504 described later.

In addition, as illustrated in FIG. 13, the Butler matrix circuit 100 including transmission lines without a crossover is provided on the second layer 504 including a square-shaped substrate, similarly to the first layer 502. The line width of the transmission line is, for example, about several hundred μm, although the line width may be changed depending on a wavelength (frequency) of a signal to be used as well as a dielectric constant of a substrate to be used.

Specifically, as illustrated in FIG. 13, the 90° hybrid coupler 102*b* and the 90° hybrid coupler 102*d* are arranged to be bilaterally symmetrical and vertically symmetrical with respect to the center of the second layer 504, and transmission lines from the 90° hybrid couplers 102*b* and 102*d* to the output ports B1 to B4 are also arranged to be bilaterally symmetrical with respect to the center of the second layer 504. In addition, in FIG. 13, the 90° hybrid coupler 102*a* and the 90° hybrid coupler 102*c* are arranged to be bilaterally symmetrical but are not arranged to be vertically symmetrical with respect to the center of the second layer 504. Arranging the positions of the 90° hybrid coupler 102*a* and the 90° hybrid coupler 102*c* not to be vertically symmetrical with respect to the center of the second layer 504 allows the lengths of transmission lines coupled to the input ports A1 to A4 (in particular, the vias 510*a* to 510*d*) to differ from each other. Such a difference in the lengths of transmission lines allows for formation of the 90° delay circuits 104*a* and 104*b*.

The Butler matrix circuit 100 according to the present embodiment is able to be configured by transmission lines provided on one layer 504, thus making it possible to provide a small-scale circuit as compared with a case where four phase shifters (components) are provided. As a result, according to the present embodiment, the second layer 504 is allowed to have an equivalent size (area) to the first layer 502 provided with the patch antennas 508*a* to 508*d* described above. In addition, in the present embodiment, the Butler matrix circuit 100 is able to be configured by transmission lines without a crossover on one layer 504, thus causing the layer configuring the Butler matrix circuit 100 not to have an increased thickness. Further, the Butler matrix circuit 100 is mainly configured by symmetrical transmission lines, and therefore is easy to design and also has a high degree of freedom of design, thus making it also easy to further reduce an area of the second layer 504.

In addition, the Butler matrix circuit 100 according to the present embodiment is able to be configured by the transmission lines, and thus has smaller transmission loss as compared with a case where a component such as a phase shifter is used. Accordingly, according to the present embodiment, eliminating the use of the component makes it possible to suppress an increase in manufacturing costs as well as to effectively increase the signal output of the phased array antenna 200.

Next, as illustrated in FIG. 14, similarly to the first layer 502, the switches 302*a* and 302*b*, the filters 304*a* and 304*b*, the LNA 306, and the PA 308 are provided on the third layer 506 including a square-shaped substrate. The switches 302*a* and 302*b*, the filters 304*a* and 304*b*, the LNA 306, and the PA 308 each include components such as semiconductor circuits, and the components are electrically coupled to each other by a wire 512 or the like. Further, the wire 512 is electrically coupled to a terminal 518 provided on an outer periphery by an electrode pad 514 and a wiring line 516 provided on the third layer 506.

Then, the three layers of the first to third layers 502, 504, and 506 are overlapped, thereby making it possible to form the front-end module 500 as illustrated in FIG. 15. In FIG. 15, the front-end module 500 includes a substrate 520 (a first substrate), a substrate 528 (a second substrate), and a substrate 530. Further, the substrate 520 is provided, on a front surface (a second surface), with the first layer 502, and, on a back surface (a first surface), with the second layer 504.

More particularly, as illustrated in FIG. 15, a patch antenna 808 provided on the first layer 502 and the output ports B1 to B4 provided on the second layer 504 are electrically coupled by the via 510 that passes through the substrate 520. In addition, the input ports A1 to A4 provided on the second layer 504 and the terminal 518 provided on the third layer 506 are electrically coupled by a via 522. Further, the terminal 518 provided on the third layer 506 and the substrate 530 provided at the lowermost tier of the front-end module 500 are electrically coupled by a via 524 that passes through the substrate 528 and a bump 526. Such a front-end module 500 is formed by forming the bump 526 or the like after wire bonding is performed in each of the substrates 520 and 528 and by stacking the substrates 520, 528, and 530.

<3.2 Power Feeding Method>

Next, description is given, with reference to FIGS. 16 and 17, of a method of power feeding from the Butler matrix circuit 100 to the patch antenna 508 in the front-end module 500 according to the present embodiment. In the present embodiment, power is able to be fed directly from the Butler matrix circuit 100 to the patch antenna 508 by the via 510 as illustrated in FIG. 16. That is, the via 510 electrically couples the Butler matrix circuit 100 and the patch antenna 508 directly together.

In addition, in the present embodiment, power is able to be fed from the Butler matrix circuit 100 to the patch antenna 508 using the slot 532 as well, as illustrated in FIG. 17. Particularly, the slot 532 includes a feeding pad 538 having an opening 536 facing a predetermined region of the wiring line 516 provided on the second layer 504, and a feeding pad 534 provided to face the opening 536. The predetermined region of the wiring line 516 and the feeding pad 534 are electromagnetically coupled to each other, thus making it possible to feed power to the patch antenna 508.

It is to be noted that, in the present embodiment, any of the above-described power feeding methods is applicable. However, the power feeding method using the slot 532 allows for impedance matching in a wide band, as compared with the power feeding method using the via 510; it is therefore preferable to use the power feeding method using the slot 532 in the present embodiment in order to avoid mismatch of the impedance matching and to reduce manufacturing processes.

As described above, in the present embodiment, the Butler matrix circuit 100 is able to be implemented in transmission lines without a crossover on one layer 502, thus making it possible to reduce thickness of the front-end module 500 including the Butler matrix circuit 100 without increasing the thickness of each of the layers configuring the Butler matrix circuit 100. In addition, the Butler matrix circuit 100 is configured by symmetrical transmission lines, and therefore is easy to design and also has a high degree of freedom of design, thus making it easy to further reduce an area of the second layer 504 on which the Butler matrix circuit 100 is provided.

4. Third Embodiment

Figure 18:
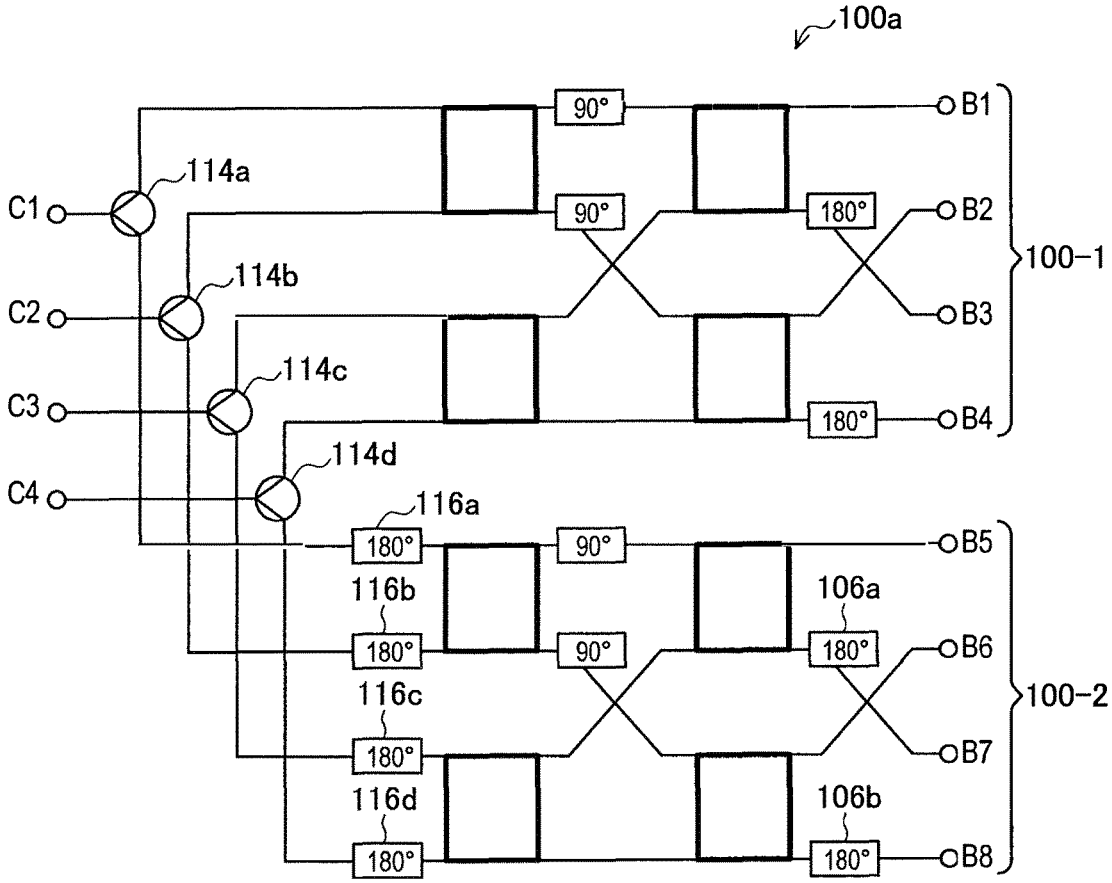
FIG. 18 is a configuration diagram of a Butler matrix circuit 100*a* according to a third embodiment of the present disclosure.
Figure 19:
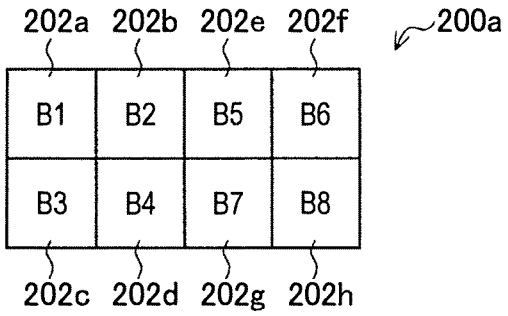
FIG. 19 is an explanatory diagram that describes an example of phases of signals to be outputted to a phased array antenna 200*a* to which the Butler matrix circuit 100*a* according to the same embodiment is applied.

A plurality of the Butler matrix circuit 100 described above may be combined into one Butler matrix circuit 100*a*. Referring now to FIGS. 18 and 19, description is given, as a third embodiment of the present disclosure, of the Butler matrix circuit 100*a* in which two Butler matrix circuits 100 are combined. FIG. 18 is a configuration diagram of the Butler matrix circuit 100*a* according to the present embodiment, and FIG. 19 is an explanatory diagram that describes an example of phases of signals to be outputted to the phased array antenna 200*a* to which the Butler matrix circuit 100*a* according to the present embodiment is applied.

As illustrated in FIG. 18, the Butler matrix circuit 100*a* according to the present embodiment includes two Butler matrix circuits 100-1 and 100-2 according to the first embodiment, four input ports C1 to C4, and eight output ports B1 to B8. Particularly, in the Butler matrix circuit 100*a*, the input ports C1 to C4 are coupled to dividers 114*a* to 114*d*, respectively, and the respective dividers 114*a* to 114*d* equally distribute signals to the input ports A1 to A4 having the same reference numerals of each of the Butler matrix circuits 100-1 and 100-2. In addition, 180° delay circuits 116*a* to 116*d* are provided, respectively, between the dividers 114*a* to 114*d* and the input ports A1 to A4 of one Butler matrix circuit 100-2. Further, the Butler matrix circuits 100-1 and 100-2 to which the distributed signals are inputted are coupled to the eight output ports B1 to B8.

It is to be noted that, in the example of FIG. 18, the 180° delay circuits 116*a* to 116*d* are provided, respectively, between the dividers 114*a* to 114*d* and the input ports A1 to A4 of the one Butler matrix circuit 100-2; however, the Butler matrix circuit 100*a* according to the present embodiment is not limited thereto. For example, the 180° delay circuits 116*a* to 116*d* may be arranged between the one Butler matrix circuit 100-2 and the output ports B5 to B8. That is, a 180° delay circuit may be provided between the 90° hybrid coupler 102*b* of the one Butler matrix circuit 100-2 and the output port B5, and a 180° delay circuit may be provided between the 90° hybrid coupler 102*d* of the one Butler matrix circuit 100-2 and the output port B6. In this case, the 180° delay circuit 106*a* provided between the 90° hybrid coupler 102*b* of the one Butler matrix circuit 100-2 and the output port B7 is not disposed, and the 180° delay circuit 106*b* provided between the 90° hybrid coupler 102*d* of the one Butler matrix circuit 100-2 and the output port B8 is not disposed, either.

Here, the Butler matrix circuit 100*a* according to the present embodiment is applied to the phased array antenna 200*a* in which eight antennas are arranged in two rows and four columns as illustrated in the upper tier of FIG. 19, for example. It is to be noted that, in the phased array antenna 200*a*, as illustrated in the upper tier of FIG. 19, the antenna 202*a* located in the first row and the first column is coupled to the output port B1 of the Butler matrix circuit 100*a*, and the antenna 202*b* located in the first row and the second column is coupled to the output port B2 of the Butler matrix circuit 100*a*. The antenna 202*c* located in the second row and the first column is coupled to the output port B3 of the Butler matrix circuit 100*a*, and the antenna 202*d* located in the second row and the second column is coupled to the output port B4 of the Butler matrix circuit 100*a*. In addition, an antenna 202*e* located in the first row and third column is coupled to the output port B5, and an antenna 202*f* located in the first row and the fourth column is coupled to the output port B6. Further, an antenna 202*g* located in the second row and the third column is coupled to the output port B7, and an antenna 202*h* located in the second row and the fourth column is coupled to the output port B8. That is, the phased array antenna 200*a* according to the present embodiment has an arrangement in which two phased array antennas 200 in two rows and two columns according to the first embodiment are arranged side by side to allow a signal having a phase difference of 180° to be inputted.

In such a phased array antenna 200*a*, the phases of signals to be outputted to the respective antennas 202*a* to 202*d* have values as illustrated in the lower tiers of FIG. 19. Specifically in a case where a signal is inputted to the input port C1 of the Butler matrix circuit 100*a*, the phases of the output signals to be outputted from the antennas 202*a* to 202*h* are, respectively, 90°, 180°, 270°, 360°, 0°, 90°, 180°, and 270° in the order of the first row and the first column, the first row and the second column, the first row and the third column, the first row and the fourth column, the second row and the first column, the second row and the second column, the second row and the third column, and the second row and the fourth column, as illustrated in left side of the second tier of FIG. 19. In addition, in a case where a signal is inputted to the input port C2 of the Butler matrix circuit 100*a*, the phases of the output signals to be outputted from the antennas 202*a* to 202*h* are, respectively, 180°, 90°, 0°, −90°, 90°, 0°, −90°, and −180° in the order of the first row and the first column, the first row and the second column, the first row and the third column, the first row and the fourth column, the second row and the first column, the second row and the second column, the second row and the third column, and the second row and the fourth column, as illustrated in right side of the second tier of FIG. 19.

That is, in the present embodiment, the phases of the output signals to be outputted from the respective antennas 202*a* to 202*h* are such that the antennas in one row and four columns with each phase shifted by 90° are arranged in two rows at a phase difference of 90°. This allows, in the present embodiment, the phased array antenna 200*a* to be obtained that switches among directivities in four directions of upper right, upper left, lower right, and lower left.

It is to be noted that, in the above description, the respective antennas 202*a* to 202*h* are assumed to be arranged in two rows and four columns, but this is not limitative; the phased array antenna 200*a* according to the present embodiment may be configured by the antennas 202*a* to 202*h* arranged in four rows and two columns.

5. Fourth Embodiment

Figure 20:
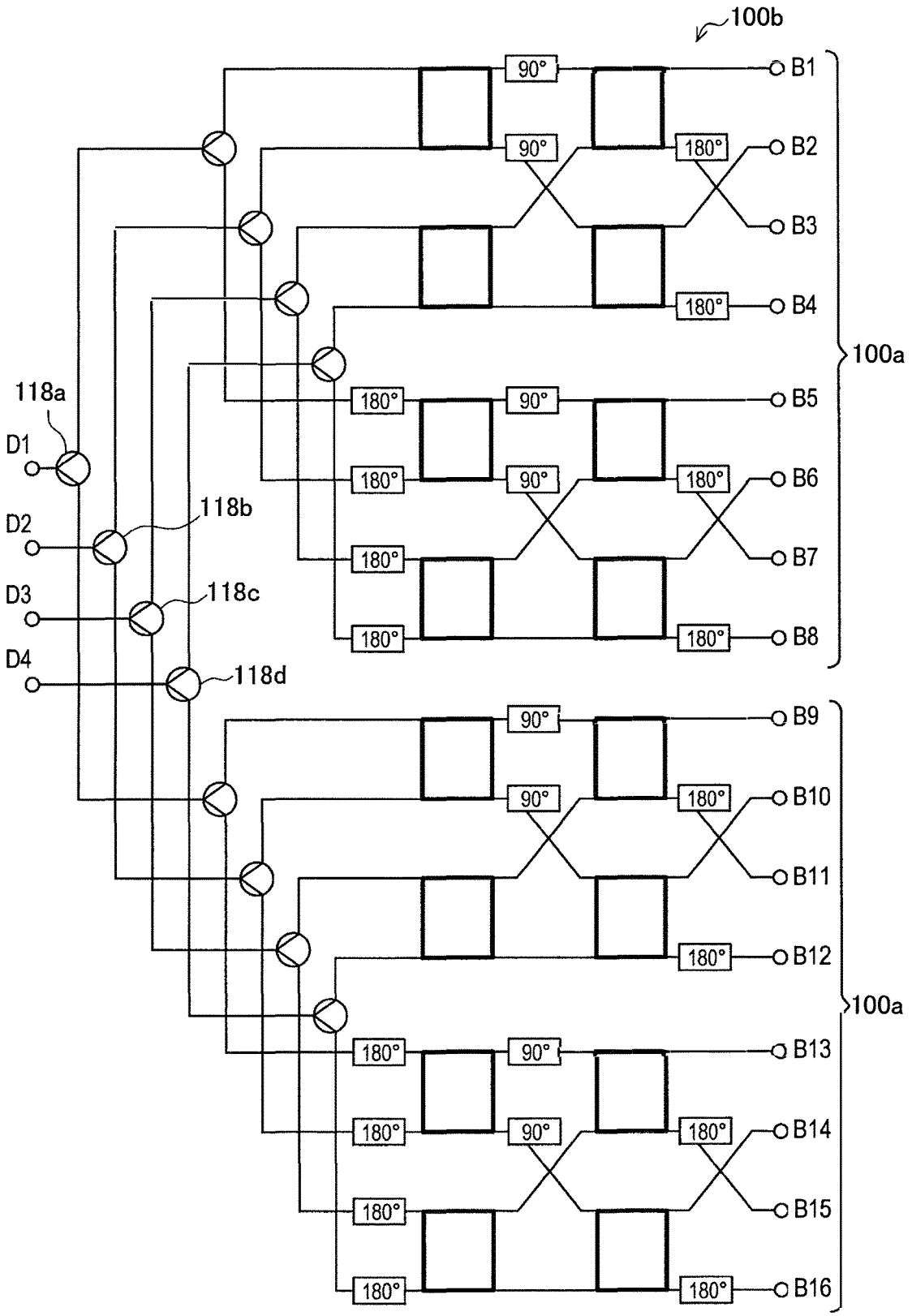
FIG. 20 is a configuration diagram of a Butler matrix circuit 100*b* according to a fourth embodiment of the present disclosure.
Figure 21:
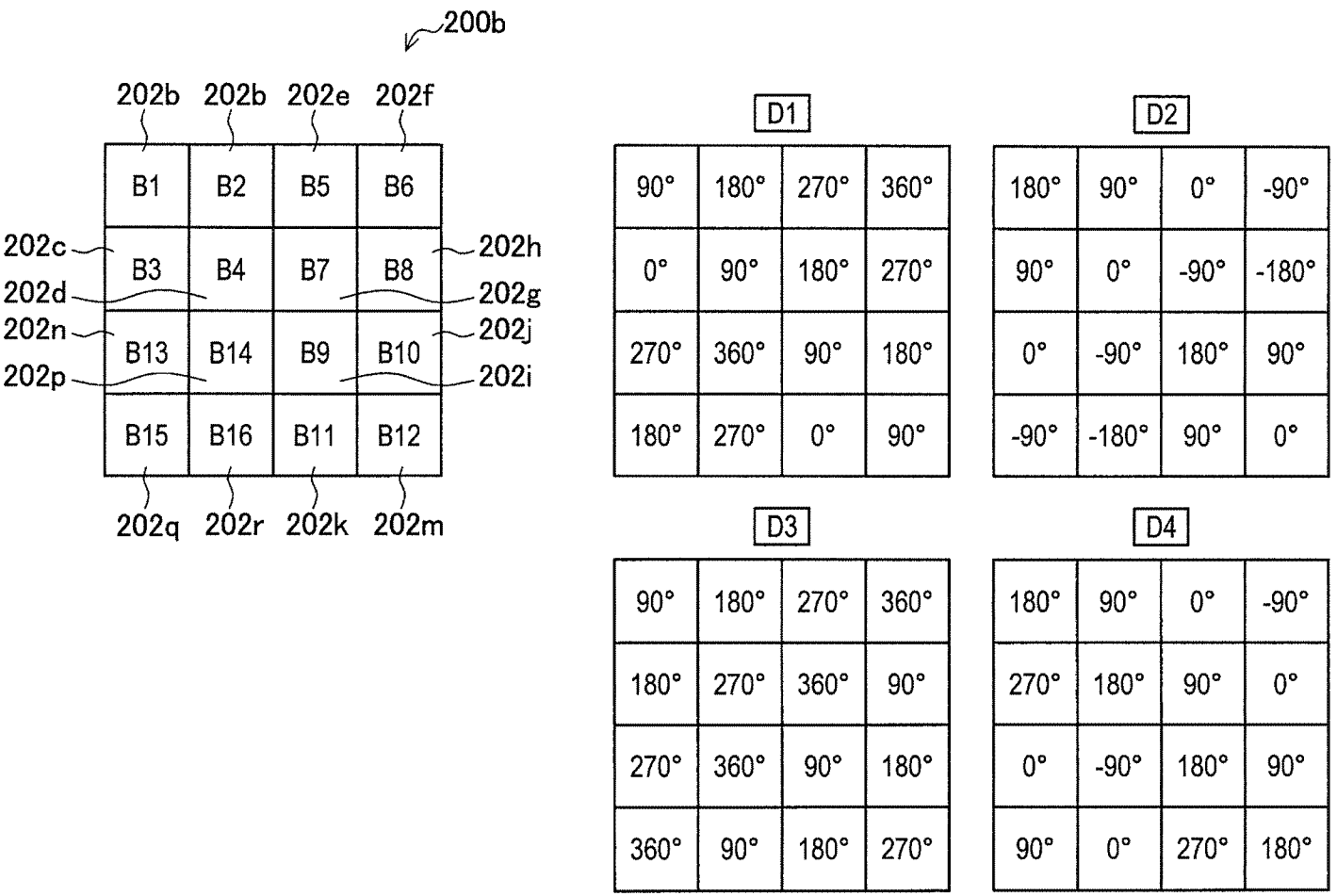
FIG. 21 is an explanatory diagram that describes an example of phases of signals to be outputted to a phased array antenna 200*b* to which the Butler matrix circuit 100*b* according to the same embodiment is applied.

Next, with reference to FIGS. 20 and 21, description is given, as a fourth embodiment of the present disclosure, of a Butler matrix circuit 100*b* in which two Butler matrix circuits 100*a* according to the third embodiment are combined. FIG. 20 is a configuration diagram of the Butler matrix circuit 100*b* according to the present embodiment, and FIG. 21 is an explanatory diagram that describes an example of phases of signals to be outputted to the phased array antenna 200*b* to which the Butler matrix circuit 100*b* according to the present embodiment is applied.

As illustrated in FIG. 20, the Butler matrix circuit 100*b* according to the present embodiment includes two Butler matrix circuits 100*a* according to the third embodiment, four input ports D1 to D4 (first to fourth terminals), and sixteen output ports B1 to B16. In addition, in the Butler matrix circuit 100*b*, the respective input ports D1 to D4 are coupled, respectively, to dividers 118*a* to 118*d*, and the respective dividers 118*a* to 118*d* equally distribute signals to the input ports C1 to C4 having the same reference numerals of each of the Butler matrix circuits 100*a*. Further, the Butler matrix circuits 100*a* to which the distributed signals are inputted are coupled to the sixteen output ports B1 to B16. That is, the Butler matrix circuit 100*b* according to the present embodiment includes four Butler matrix circuit 100 according to the first embodiment.

Here, the Butler matrix circuit 100*b* according to the present embodiment is applied to the phased array antenna 200*b* in which sixteen antennas are arranged in four rows and four columns as illustrated in the upper tier of FIG. 21, for example. It is to be noted that, in the phased array antenna 200*b*, as illustrated in the upper tier of FIG. 21, the antenna 202*a* located in the first row and the first column to the antenna 202*h* located in the second row and the fourth column are coupled, respectively, to the output ports B1 to B8 (the antenna-side terminals) of the Butler matrix circuit 100*b*, similarly to the third embodiment. Further, an antenna 202*i* located in the third row and the third column is coupled to the output port B9 of the Butler matrix circuit 100*b*; an antenna 202*h* located in the third row and the fourth column is coupled to the output port B10 of the Butler matrix circuit 100*b*; an antenna 202*k* located in the fourth row and the third column is coupled to the output port B11; and an antenna 202*m* located in the fourth row and the fourth column is coupled to the output port B12. In addition, an antenna 202*n* located in the third row and the first column is coupled to the output port B13; an antenna 202*p* located in the third row and the second column is coupled to the output port B14; an antenna 202*q* located in the fourth row and the first column is coupled to the output port B15; and an antenna 202*r* located in the fourth row and the second column is coupled to the output port B16. That is, the phased array antenna 200*b* according to the present embodiment has an arrangement in which two phased array antennas 200*a* in two rows and four columns according to the third embodiment are arranged vertically.

It is to be noted that, also in the present embodiment, similarly to the second embodiment, an antenna 202 and an antenna 202 to be paired therewith may have a positional relationship (shape) of 180° inversion from each other to thereby configure the 180° delay circuits 106*a* and 106*d* of each Butler matrix circuit 100. That is, also in the present embodiment, the antennas 202 arranged in even-numbered rows of each column may have a shape of 180° inversion of the antennas 202 arranged in odd-numbered rows of an identical column. It is to be noted that, the present embodiment is not limited thereto; for example, the antennas 202 arranged in even-numbered columns of each row may have a shape of 180° inversion of the antennas 202 arranged in odd-numbered columns of an identical row.

In such a phased array antenna 200*b*, the phases of the signals to be outputted to the respective antennas 202*a* to 202*r* have values as illustrated on right side of FIG. 21. That is, in the present embodiment, phases of output signals to be outputted from the antennas 202*a* to 202*r* are such that antennas in one row and four columns with each phase shifted by 90° are arranged in four rows at a phase difference of 90°. This makes it possible to obtain the phased array antenna 200*b* which switches among directivities in four directions of upper right, upper left, lower right, and lower left.

As described above, according to the Butler matrix circuit 100 of the present embodiment, the phased array antenna 200*b* including the sixteen antennas 202 arranged in four rows and four columns also makes it possible to further reduce the volume and power consumption of the blocks of the phased array antenna 200*b*. Further, according to the Butler matrix circuit 100, the phased array antenna 200*b* including the sixteen antennas 202 arranged in four rows and four columns also allows for symmetrical radiation characteristics, similarly to the first embodiment.

It is to be noted that, in a case where the phased array antenna 200 is configured by arranging many antennas 202 as in the third and fourth embodiments described above, the shapes of radio wave beams radiated from the phased array antenna 200 become sharp, thus enhancing the directivity of the phased array antenna 200. Accordingly, in the technique of the present disclosure, it is preferable to select the number and arrangement of the antennas 202 to achieve a desired directivity.

6. Application Examples

The above-described technique such as the front-end module 500 according to the present embodiment in which the volume and power consumption are further reduced can be mounted on various wireless communication terminals such as a smartphone, a tablet, a wearable terminal, a notebook PC (Personal Computer), a mobile router, an in-vehicle wireless module (e.g., a car navigation system), a robot, a drone, and an IC (Integrated Circuit)-TAG which are requested to reduce the volume and power consumption. That is, the technique according to the present disclosure is applicable to various wireless communication terminals. It is to be noted that, in such a case, the signal handled by the wireless communication terminal is not limited to a millimeter wave as described above. Description is given below of various application examples of the present embodiment.

<6.1 Wireless Communication>

The technique according to the present disclosure is applicable to a wireless communication unit of a control entity, a base station, a terminal apparatus, or the like. For example, the control entity may be implemented as any type of server, such as a tower server, a rack server, or a blade server. In addition, the control entity may be a control module (e.g., an integrated circuit module configured by one die, or a card or a blade to be inserted into a slot of the blade server) to be mounted on the server.

In addition, for example, the base station may be implemented as any type of eNB (evolved Node B), such as a macro eNB or a small eNB. The small eNB may be an eNB that covers a smaller cell than a macro cell, such as a pico eNB, a micro eNB, or a home (femto) eNB. Alternatively, the base station may be implemented as a Node B or another type of base station such as a BTS (Base Transceiver Station). The base station may include a main body (also referred to as a base station apparatus) that controls wireless communication, and one or more RRHs (Remote Radio HEAD) disposed in a different location from the main body. In addition, various types of terminals described later may execute base station functions temporarily or semi-permanently to thereby operate as the base station.

In addition, for example, the terminal apparatus may be implemented as a mobile terminal such as a smartphone, a tablet PC (Personal Computer), a notebook PC, a portable gaming terminal, a portable/dongle type mobile router or a digital camera, or an in-vehicle terminal such as a car navigation apparatus. In addition, the terminal apparatus may be implemented as a terminal (also referred to as an MTC (Machine Type Communication) terminal) that performs M2M (Machine To Machine) communication. Further, the terminal apparatus may be a wireless communication module (e.g., an integrated circuit module configured by one die) to be mounted on such a terminal.

6.1.1. Application Examples of Control Entity

FIG. 25 is a block diagram illustrating an example of a schematic configuration of a server 700 to which a technique according to the present disclosure is applicable. The server 700 includes a processor 701, a memory 702, a storage 703, a network interface 704, and a bus 706.

The processor 701 may be, for example, a CPU (Central Processing Unit) or a DSP (Digital Signal Processor), and controls various functions of the server 700. The memory 702 includes a RAM (Random Access Memory) and a ROM (Read Only Memory), and stores programs to be executed by the processor 701 and data. The storage 703 may include a storage medium such as a semiconductor memory or a hard disk.

The network interface 704 is a wired communication interface for coupling the server 700 to a wireless communication network 705. The wireless communication network 705 may be a core network such as an EPC (Evolved Packet Core) or may be a PDN (Packet Data Network) such as the Internet.

The bus 706 couples the processor 701, the memory 702, the storage 703, and the network interface 704 to one another. The bus 706 may include two or more buses of different speeds (e.g., a high-speed bus and a low-speed bus).

6.1.2. Application Example of Base Station

First Application Example

Figure 26:
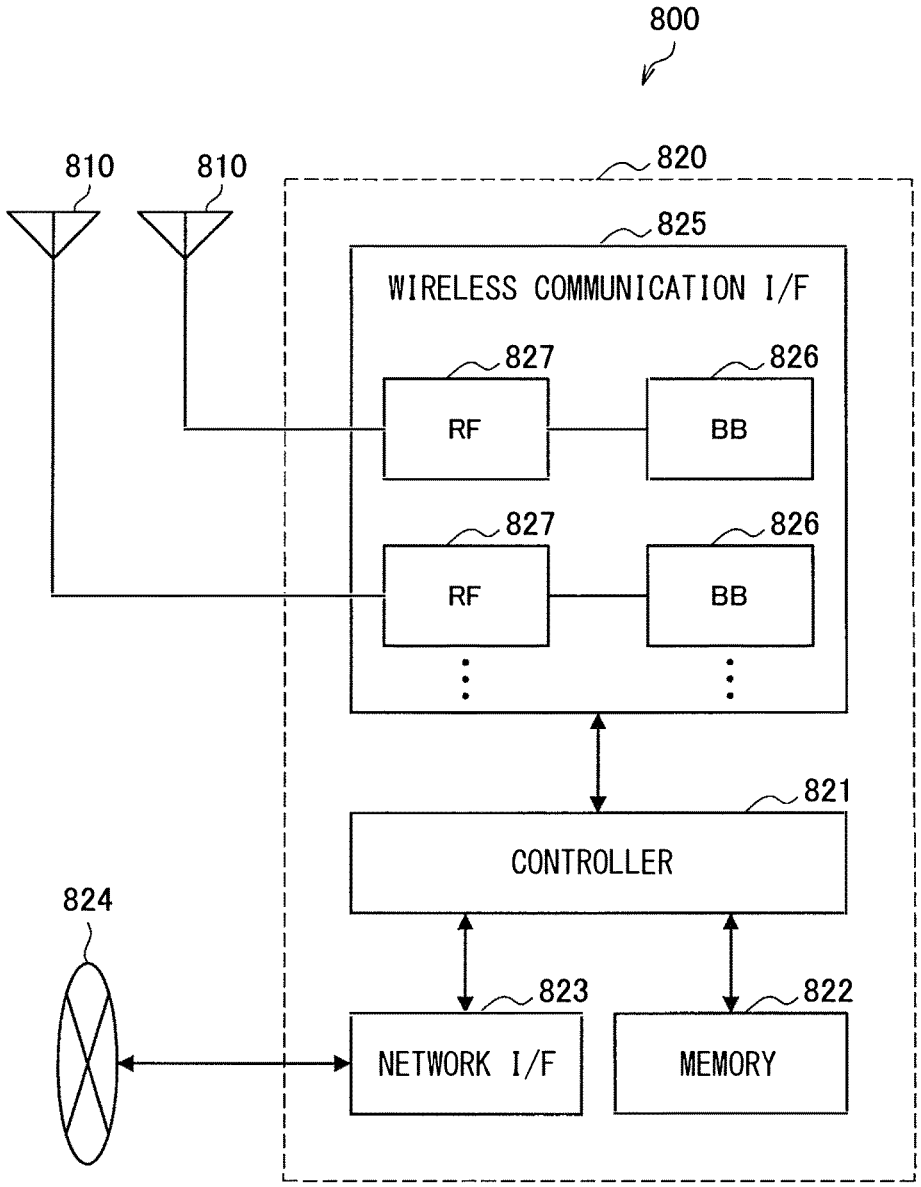
FIG. 26 is a block diagram illustrating a first example of a schematic configuration of an eNB 800.

FIG. 26 is a block diagram illustrating a first example of a schematic configuration of an eNB 800 to which a technology of the present disclosure is applicable. The eNB 800 includes one or more antennas 810 and a base station apparatus 820. Each of the antennas 810 and the base station apparatus 820 may be coupled to each other via an RF cable.

Each of the antennas 810 includes a single or a plurality of antenna elements (e.g., a plurality of antenna elements configuring a MIMO (Multiple Input and Multiple Output) antenna, and is used for transmission and reception of radio signals by the base station apparatus 820. The eNB 800 includes a plurality of antennas 810 as illustrated in FIG. 26, and the plurality of antennas 810 may correspond to respective frequency bands to be used by the eNB 800, for example. It is to be noted that FIG. 26 illustrates the example in which the eNB 800 includes the plurality of antennas 810, but the eNB 800 may include a single antenna 810.

The base station apparatus 820 includes a controller 821, a memory 822, a network interface 823, and a wireless communication interface 825.

The controller 821 may be a CPU or a DSP, for example, and operates various functions of upper layers of the base station apparatus 820. For example, the controller 821 generates a data packet from data inside a signal processed by the wireless communication interface 825, and transfers the generated packet via the network interface 823. The controller 821 may generate a bundled packet by bundling data from a plurality of baseband processors, and transfer the generated bundled packet. In addition, the controller 821 may have logical functions to execute a control such as radio resource management (Radio Resource Control), radio bearer control (Radio Bearer Control), mobility management (Mobility Management), inflow control (Admission Control), or scheduling (Scheduling). In addition, this control may be executed in conjunction with a peripheral eNB or core network node. The memory 822 includes a RAM and a ROM, and stores programs to be executed by the controller 821 and various control data (e.g., terminal lists, transmission power data, scheduling data, etc.).

The network interface 823 is a communication interface for coupling the base station apparatus 820 to the core network 824. The controller 821 may communicate with a core network node or another eNB via the network interface 823. In such a case, the eNB 800 and the core network node or the other eNB may be coupled to each other by a logical interface (e.g., an S1 interface or an X2 interface). The network interface 823 may be a wired communication interface, or may be a wireless communication interface for a wireless backhaul. In a case where the network interface 823 is a wireless communication interface, the network interface 823 may use, for wireless communication, a higher frequency band than a frequency band to be used by the wireless communication interface 825.

The wireless communication interface 825 supports any cellular communication scheme, such as LTE (Long Term Evolution) or LTE-Advanced, and provides wireless coupling to a terminal located inside a cell of the eNB 800 via the antenna 810. The wireless communication interface 825 may typically include a base band (BB) processor 826, an RF circuit 827, and the like. The BB processor 826 may perform, for example, encoding/decoding, modulation/demodulation, multiplexing/demultiplexing, and the like, and executes various types of signal processing of each of layers (e.g., L1, MAC (Medium Access Control), RLC (Radio Link Control), and PDCP (Packet Data Convergence Protocol)). Instead of the controller 821, the BB processor 826 may have some or all of the logical functions described above. The BB processor 826 may be a module including a memory that stores a communication control program, a processor that executes the program, and an associated circuit; functions of the BB processor 826 may be modifiable by updating the program. In addition, the module may be a card or a blade to be inserted into a slot of the base station apparatus 820, or a chip to be mounted on the card or the blade. Meanwhile, the RF circuit 827 may include a mixer, a filter, an amplifier, and the like, and transmits and receives radio signals via the antenna 810.

The wireless communication interface 825 includes a plurality of BB processors 826 as illustrated in FIG. 26, and the plurality of BB processors 826 may correspond to the respective frequency bands to be used by the eNB 800, for example. In addition, the wireless communication interface 825 includes a plurality of RF circuits 827 as illustrated in FIG. 26, and the plurality of RF circuits 827 may correspond to respective antenna elements, for example. It is to be noted that, although FIG. 26 illustrates the example in which the wireless communication interface 825 includes the plurality of BB processors 826 and the plurality of RF circuits 827, the wireless communication interface 825 may include a single BB processor 826 or a single RF circuit 827.

Second Application Example

Figure 27:
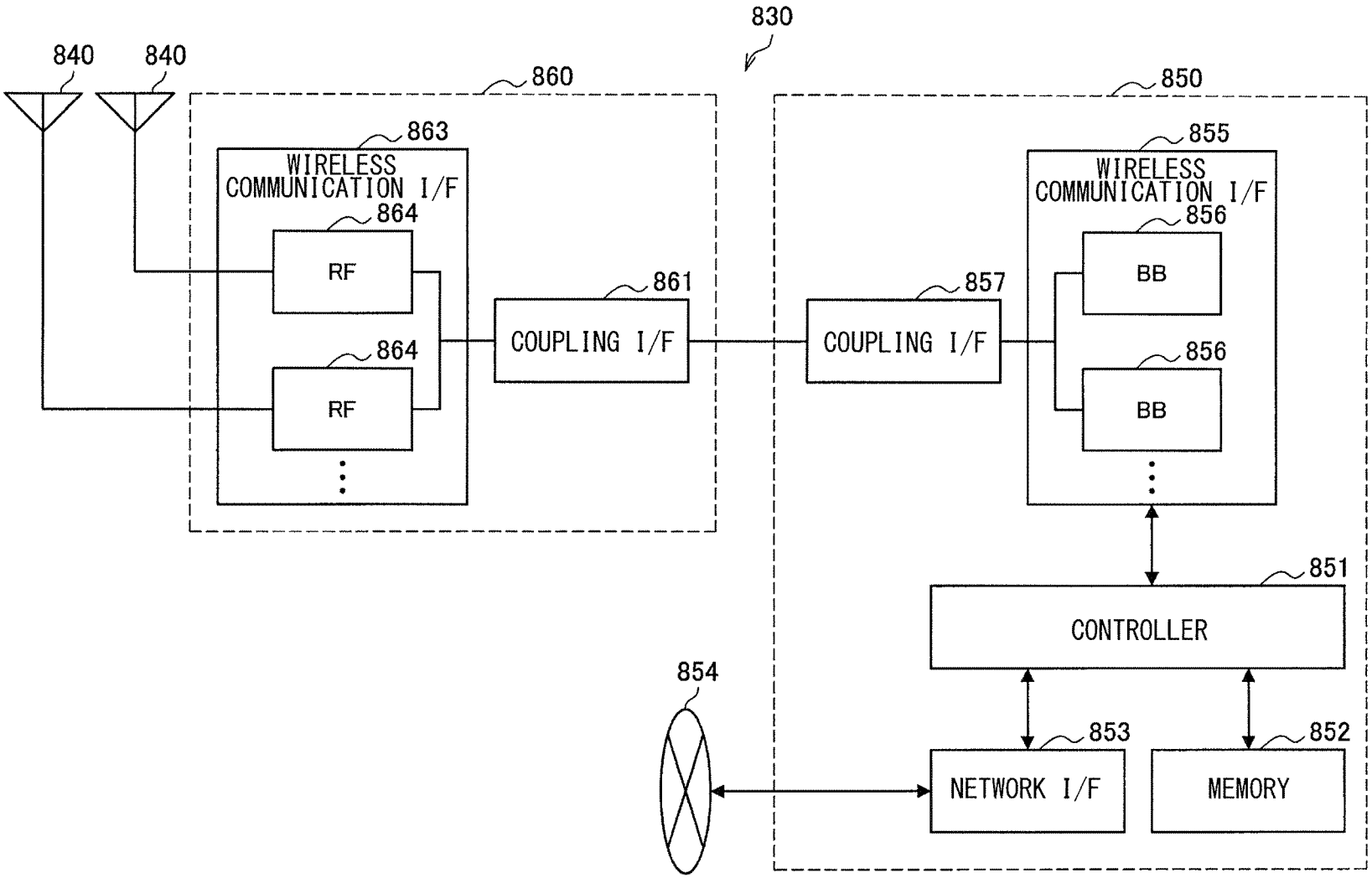
FIG. 27 is a block diagram illustrating a second example of a schematic configuration of an eNB 830.

FIG. 27 is a block diagram illustrating a second example of a schematic configuration of an eNB 830 to which a technique of the present disclosure is applicable. The eNB 830 includes one or more antennas 840, a base station apparatus 850, and an RRH 860. Each of the antennas 840 and the RRH 860 may be coupled to each other via an RF cable. In addition, the base station apparatus 850 and the RRH 860 may be coupled to each other by a high-speed line such as an optical fiber cable.

Figure 28:
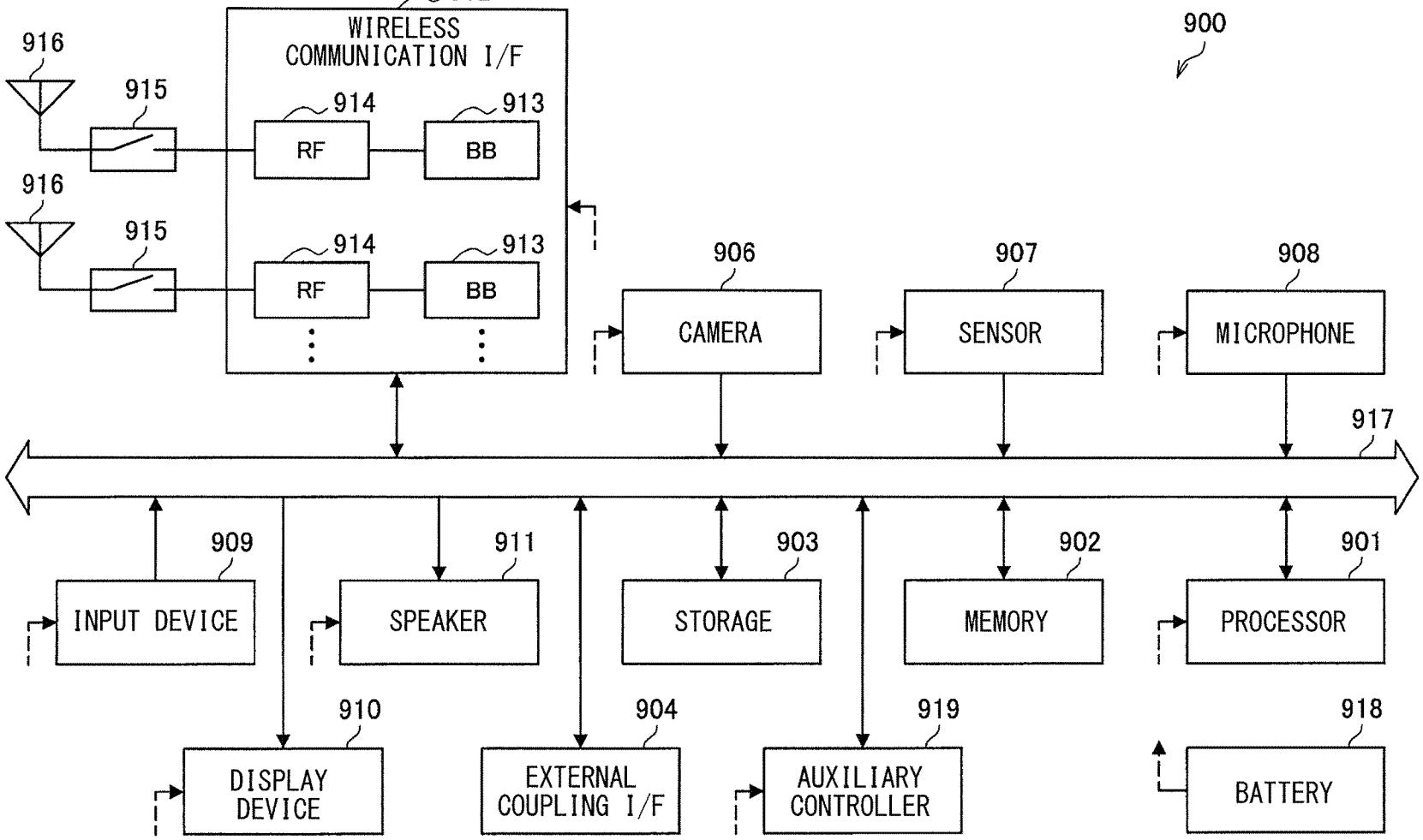
FIG. 28 is a block diagram illustrating an example of a schematic configuration of a smartphone 900.

Each of the antennas 840 includes a single or a plurality of antenna elements (e.g., a plurality of antenna elements configuring the MIMO antenna), and is used for transmission and reception of radio signals by the RRH 860. The eNB 830 may include a plurality of antennas 840 as illustrated in FIG. 27, and the plurality of antennas 840 may correspond to respective frequency bands to be used by the eNB 830, for example. It is to be noted that, although FIG. 28 illustrates the example in which the eNB 830 includes the plurality of antennas 840, the eNB 830 may include a single antenna 840.

The base station apparatus 850 includes a controller 851, a memory 852, a network interface 853, a wireless communication interface 855, and a coupling interface 857. The controller 851, the memory 852, and the network interface 853 are similar to the controller 821, the memory 822, and the network interface 823 described with reference to FIG. 26.

The wireless communication interface 855 supports any cellular communication scheme, such as LTE or LTE-Advanced, and provides wireless coupling, via the RRH 860 and the antenna 840, to a terminal located inside a sector corresponding to the RRH 860. The wireless communication interface 855 may typically include a BB processor 856 or the like. The BB processor 856 is similar to the BB processor 826 described with respect to FIG. 26, except that the BB processor 856 is coupled to an RF circuit 864 of the RRH 860 via the coupling interface 857. The wireless communication interface 855 includes a plurality of BB processors 856 as illustrated in FIG. 27, and the plurality of BB processors 856 may correspond to the respective frequency bands to be used by the eNB 830, for example. It is to be noted that, although FIG. 27 illustrates the example in which the wireless communication interface 855 includes the plurality of BB processors 856, the wireless communication interface 855 may include a single BB processor 856.

The coupling interface 857 is an interface for coupling the base station apparatus 850 (the wireless communication interface 855) to the RRH 860. The coupling interface 857 may be a communication module for communication by the above-described high-speed line that couples the base station apparatus 850 (the wireless communication interface 855) and the RRH 860.

In addition, the RRH 860 includes a coupling interface 861 and a wireless communication interface 863.

The coupling interface 861 is an interface for coupling the RRH 860 (the wireless communication interface 863) to the base station apparatus 850. The coupling interface 861 may be a communication module for communication by the above-described high-speed line.

The wireless communication interface 863 transmits and receives radio signals via the antenna 840. The wireless communication interface 863 may typically include the RF circuit 864 and the like. The RF circuit 864 may include a mixer, a filter, an amplifier, and the like, and transmits and receives radio signals via the antenna 840. The wireless communication interface 863 includes a plurality of RF circuits 864 as illustrated in FIG. 27, and the plurality of RF circuits 864 may correspond to respective antenna elements, for example. It is to be note that, although FIG. 27 illustrates the example in which the wireless communication interface 863 includes the plurality of RF circuits 864, the wireless communication interface 863 may include a single RF circuit 864.

6.1.3. Application Examples of Mobile Terminal

First Application Example

FIG. 28 is a block diagram illustrating an example of a schematic configuration of a smartphone 900 to which a technique of the present disclosure is applicable. The smartphone 900 includes a processor 901, a memory 902, a storage 903, an external coupling interface 904, a camera 906, a sensor 907, a microphone 908, an input device 909, a display device 910, a speaker 911, a wireless communication interface 912, one or more antenna switches 915, one or more antennas 916, a bus 917, a battery 918, and an auxiliary controller 919.

The processor 901 may be, for example, a CPU or a SoC (System on Chip), and controls functions of an application layer and other layers of the smartphone 900. The memory 902 includes a RAM and a ROM, and stores programs to be executed by the processor 901 and data. The storage 903 may include a storage medium such as a semiconductor memory or a hard disk. The external coupling interface 904 is an interface for coupling an external device such as a memory card or a USB (Universal Serial Bus) device to the smartphone 900.

The camera 906 includes, for example, an imaging element such as a CCD (Charge Coupled Device) or a CMOS (Complementary Metal Oxide Semiconductor), and generates a captured image. The sensor 907 may include, for example, a sensor group such as a positioning sensor, a gyro sensor, a geomagnetic sensor, and an acceleration sensor. The microphone 908 converts a sound inputted to the smartphone 900 into an audio signal. The input device 909 includes, for example, a touch sensor that detects a touch on a screen of the display device 910, a keypad, a keyboard, a button, a switch, or the like, and accepts an operation or information inputted by a user. The display device 910 includes a screen such as a liquid crystal display (LCD) or an organic light-emitting diode (OLED) display to display an output image of the smartphone 900. The speaker 911 converts an audio signal outputted from the smartphone 900 into a sound.

The wireless communication interface 912 supports any cellular communication scheme, such as LTE or LTE-Advanced, and executes wireless communication. The wireless communication interface 912 may typically include a BB processor 913, an RF circuit 914, and the like. The BB processor 913 may perform, for example, encoding/decoding, modulation/demodulation, multiplexing/demultiplexing, and the like, and executes various types of signal processing for wireless communication. Meanwhile, the RF circuit 914 may include a mixer, a filter, an amplifier, and the like, and transmits and receives radio signals via the antenna 916. The wireless communication interface 912 may be a one-chip module integrating the BB processor 913 and the RF circuit 914. The wireless communication interface 912 may include a plurality of BB processors 913 and a plurality of RF circuits 914, as illustrated in FIG. 28. It is to be noted that, although FIG. 28 illustrates the example in which the wireless communication interface 912 includes the plurality of BB processors 913 and the plurality of RF circuits 914, the wireless communication interface 912 may include a single BB processor 913 or a single RF circuit 914.

Further, the wireless communication interface 912 may support other types of wireless communication schemes, such as a short-range wireless communication scheme, a close-proximity wireless communication scheme, or a wireless LAN (Local Area Network) scheme, in addition to the cellular communication scheme; in such a case, the wireless communication interface 912 may include the BB processor 913 and the RF circuit 914 for each wireless communication scheme.

Each of the antenna switches 915 switches coupling destinations of the antennas 916 among a plurality of circuits (e.g., circuits for different wireless communication schemes) included in the wireless communication interface 912.

Each of the antennas 916 includes a single or a plurality of antenna elements (e.g., a plurality of antenna elements configuring the MIMO antenna), and is used for transmission and reception of radio signals by the wireless communication interface 912. The smartphone 900 may include a plurality of antennas 916 as illustrated in FIG. 28. It is to be noted that, although FIG. 28 illustrates the example in which the smartphone 900 includes the plurality of antennas 916, the smartphone 900 may include a single antenna 916.

Further, the smartphone 900 may include the antenna 916 for each wireless communication scheme. In such a case, the antenna switch 915 may be omitted from the configuration of the smartphone 900.

The bus 917 couples the processor 901, the memory 902, the storage 903, the external coupling interface 904, the camera 906, the sensor 907, the microphone 908, the input device 909, the display device 910, the speaker 911, the wireless communication interface 912, and the auxiliary controller 919 to one another. The battery 918 supplies power to each block of the smartphone 900 illustrated in FIG. 28 via a power feeding line partially indicated by a broken line in the drawing. The auxiliary controller 919 operates minimum necessary functions of the smartphone 900, for example, in a sleep mode.

Second Application Example

Figure 29:
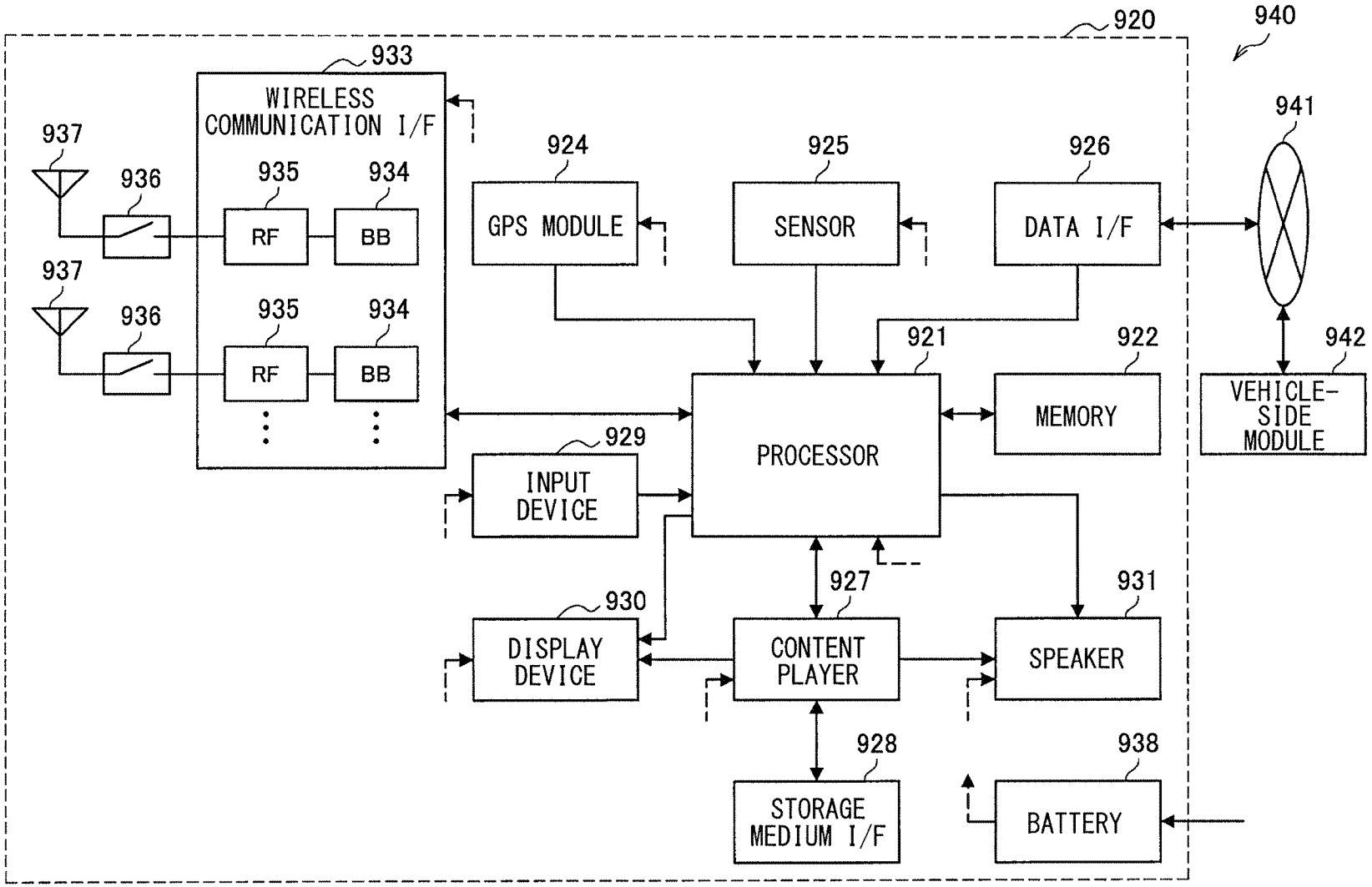
FIG. 29 is a block diagram illustrating an example of a schematic configuration of a car navigation apparatus 920.

FIG. 29 is a block diagram illustrating an example of a schematic configuration of a car navigation apparatus 920 to which a technique of the present disclosure is applicable. The car navigation apparatus 920 includes a processor 921, a memory 922, a GPS (Global Positioning System) module 924, a sensor 925, a data interface 926, a content player 927, a storage medium interface 928, an input device 929, a display device 930, a speaker 931, a wireless communication interface 933, one or more antenna switches 936, one or more antennas 937, and a battery 938.

The processor 921 may be, for example, a CPU or a SoC, and controls a navigation function and other functions of the car navigation apparatus 920. The memory 922 includes a RAM and a ROM, and stores programs to be executed by the processor 921 and data.

The GPS module 924 uses a GPS signal received from a GPS satellite to determine a position (e.g., latitude, longitude, and altitude) of the car navigation apparatus 920. The sensor 925 may include, for example, a sensor group such as a gyro sensor, a geomagnetic sensor, and a barometric sensor. The data interface 926 is coupled to a vehicle-mounted network 941 via an unillustrated terminal, for example, and acquires data generated on vehicle side, such as vehicle speed data.

The content player 927 reproduces contents stored in a storage medium (e.g., a CD or a DVD) inserted into the storage medium interface 928. The input device 929 includes, for example, a touch sensor that detects a touch on a screen of the display device 930, a button, a switch, or the like, and accepts an operation or information inputted by a user. The display device 930 includes a screen such as an LCD or OLED display to display navigation functions or sounds of contents to be reproduced. The speaker 931 outputs the navigation functions or sounds of the contents to be reproduced.

Figure 30:
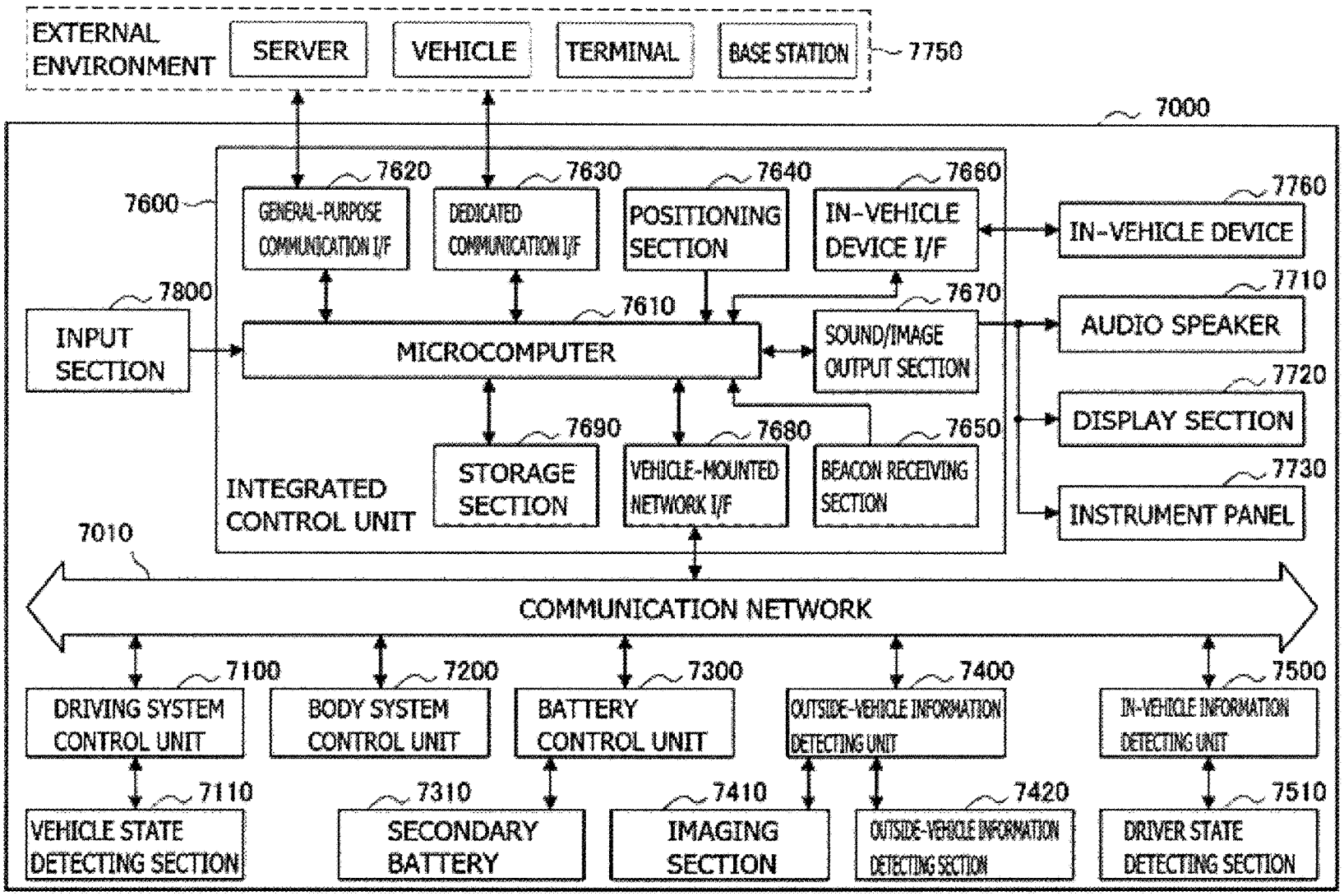
FIG. 30 is a block diagram depicting an example of schematic configuration of a vehicle control system.

The wireless communication interface 933 supports any cellular communication scheme, such as LTE or LTE-Advanced, and executes wireless communication. The wireless communication interface 933 may typically include a BB processor 934, an RF circuit 935, and the like. The BB processor 934 may perform, for example, encoding/decoding, modulation/demodulation, multiplexing/demultiplexing, and the like, and executes various types of signal processing for wireless communication. Meanwhile, the RF circuit 935 may include a mixer, a filter, an amplifier, and the like, and transmits and receives radio signals via the antenna 937. The wireless communication interface 933 may be a one-chip module integrating the BB processor 934 and the RF circuits 935. The wireless communication interface 933 may include a plurality of BB processors 934 and a plurality of RF circuits 935 as illustrated in FIG. 29. It is to be noted that, although FIG. 30 illustrates the example in which the wireless communication interface 933 includes the plurality of BB processors 934 and the plurality of RF circuits 935, the wireless communication interface 933 may include a single BB processor 934 or a single RF circuit 935.

Further, the wireless communication interface 933 may support other types of wireless communication schemes, such as a short-range wireless communication scheme, a close-proximity wireless communication scheme, or a wireless LAN scheme, in addition to the cellular communication scheme; in such a case, the wireless communication interface 933 may include the BB processor 934 and the RF circuit 935 for each wireless communication scheme.

Each of the antenna switches 936 switches coupling destinations of the antennas 937 among a plurality of circuits (e.g., circuits for different wireless communication schemes) included in the wireless the communication interface 933.

Each of the antennas 937 includes a single or a plurality of antenna elements (e.g., a plurality of antenna elements configuring the MIMO antenna), and is used for transmission and reception of radio signals by the wireless communication interface 933. The car navigation apparatus 920 may have a plurality of antennas 937 as illustrated in FIG. 29. It is to be noted that, although FIG. 29 illustrates the example in which the car navigation apparatus 920 includes the plurality of antennas 937, the car navigation apparatus 920 may have a single antenna 937.

Further, the car navigation apparatus 920 may include the antenna 937 for each wireless communication scheme. In such a case, the antenna switch 936 may be omitted from the configuration of the car navigation apparatus 920.

The battery 938 supplies power to each block of the car navigation apparatus 920 illustrated in FIG. 29 via a power feeding line partially indicated by a broken line in the drawing. In addition, the battery 938 stores power fed from the vehicle side.

In addition, the technique according to the present disclosure may be implemented as a vehicle-mounted system (or a vehicle) 940 including one or more blocks of the above-described car navigation apparatus 920, the vehicle-mounted network 941, and a vehicle-side module 942. The vehicle-side module 942 generates vehicle-side data such as a vehicle speed, an engine speed, or failure information, and outputs the generated data to the vehicle-mounted network 941.

<6.2 Vehicle Control System>

In addition, for example, the technique of the present disclosure, such as the front-end module 500 according to the present embodiment in which the volume and power consumption are further reduced may be implemented as a mobile body control apparatus to be mounted on a mobile body of any kind, such as an automobile, an electric vehicle, a hybrid electric vehicle, a motorcycle, a bicycle, any personal mobility device, an airplane, a drone, a vessel, a robot, a construction machine, and an agricultural machine (tractor).

FIG. 30 is a block diagram depicting an example of schematic configuration of a vehicle control system 7000 as an example of a mobile body control system to which the technology according to an embodiment of the present disclosure can be applied. The vehicle control system 7000 includes a plurality of electronic control units connected to each other via a communication network 7010. In the example depicted in FIG. 30, the vehicle control system 7000 includes a driving system control unit 7100, a body system control unit 7200, a battery control unit 7300, an outside-vehicle information detecting unit 7400, an in-vehicle information detecting unit 7500, and an integrated control unit 7600. The communication network 7010 connecting the plurality of control units to each other may, for example, be a vehicle-mounted communication network compliant with an arbitrary standard such as controller area network (CAN), local interconnect network (LIN), local area network (LAN), FlexRay (registered trademark), or the like.

Each of the control units includes: a microcomputer that performs arithmetic processing according to various kinds of programs; a storage section that stores the programs executed by the microcomputer, parameters used for various kinds of operations, or the like; and a driving circuit that drives various kinds of control target devices. Each of the control units further includes: a network interface (I/F) for performing communication with other control units via the communication network 7010; and a communication I/F for performing communication with a device, a sensor, or the like within and without the vehicle by wire communication or radio communication. A functional configuration of the integrated control unit 7600 illustrated in FIG. 30 includes a microcomputer 7610, a general-purpose communication I/F 7620, a dedicated communication I/F 7630, a positioning section 7640, a beacon receiving section 7650, an in-vehicle device I/F 7660, a sound/image output section 7670, a vehicle-mounted network I/F 7680, and a storage section 7690. The other control units similarly include a microcomputer, a communication I/F, a storage section, and the like.

The driving system control unit 7100 controls the operation of devices related to the driving system of the vehicle in accordance with various kinds of programs. For example, the driving system control unit 7100 functions as a control device for a driving force generating device for generating the driving force of the vehicle, such as an internal combustion engine, a driving motor, or the like, a driving force transmitting mechanism for transmitting the driving force to wheels, a steering mechanism for adjusting the steering angle of the vehicle, a braking device for generating the braking force of the vehicle, and the like. The driving system control unit 7100 may have a function as a control device of an antilock brake system (ABS), electronic stability control (ESC), or the like.

The driving system control unit 7100 is connected with a vehicle state detecting section 7110. The vehicle state detecting section 7110, for example, includes at least one of a gyro sensor that detects the angular velocity of axial rotational movement of a vehicle body, an acceleration sensor that detects the acceleration of the vehicle, and sensors for detecting an amount of operation of an accelerator pedal, an amount of operation of a brake pedal, the steering angle of a steering wheel, an engine speed or the rotational speed of wheels, and the like. The driving system control unit 7100 performs arithmetic processing using a signal input from the vehicle state detecting section 7110, and controls the internal combustion engine, the driving motor, an electric power steering device, the brake device, and the like.

The body system control unit 7200 controls the operation of various kinds of devices provided to the vehicle body in accordance with various kinds of programs. For example, the body system control unit 7200 functions as a control device for a keyless entry system, a smart key system, a power window device, or various kinds of lamps such as a headlamp, a backup lamp, a brake lamp, a turn signal, a fog lamp, or the like. In this case, radio waves transmitted from a mobile device as an alternative to a key or signals of various kinds of switches can be input to the body system control unit 7200. The body system control unit 7200 receives these input radio waves or signals, and controls a door lock device, the power window device, the lamps, or the like of the vehicle.

The battery control unit 7300 controls a secondary battery 7310, which is a power supply source for the driving motor, in accordance with various kinds of programs. For example, the battery control unit 7300 is supplied with information about a battery temperature, a battery output voltage, an amount of charge remaining in the battery, or the like from a battery device including the secondary battery 7310. The battery control unit 7300 performs arithmetic processing using these signals, and performs control for regulating the temperature of the secondary battery 7310 or controls a cooling device provided to the battery device or the like.

The outside-vehicle information detecting unit 7400 detects information about the outside of the vehicle including the vehicle control system 7000. For example, the outside-vehicle information detecting unit 7400 is connected with at least one of an imaging section 7410 and an outside-vehicle information detecting section 7420. The imaging section 7410 includes at least one of a time-of-flight (ToF) camera, a stereo camera, a monocular camera, an infrared camera, and other cameras. The outside-vehicle information detecting section 7420, for example, includes at least one of an environmental sensor for detecting current atmospheric conditions or weather conditions and a peripheral information detecting sensor for detecting another vehicle, an obstacle, a pedestrian, or the like on the periphery of the vehicle including the vehicle control system 7000.

The environmental sensor, for example, may be at least one of a rain drop sensor detecting rain, a fog sensor detecting a fog, a sunshine sensor detecting a degree of sunshine, and a snow sensor detecting a snowfall. The peripheral information detecting sensor may be at least one of an ultrasonic sensor, a radar device, and a LIDAR device (Light detection and Ranging device, or Laser imaging detection and ranging device). Each of the imaging section 7410 and the outside-vehicle information detecting section 7420 may be provided as an independent sensor or device, or may be provided as a device in which a plurality of sensors or devices are integrated.

Figure 31:
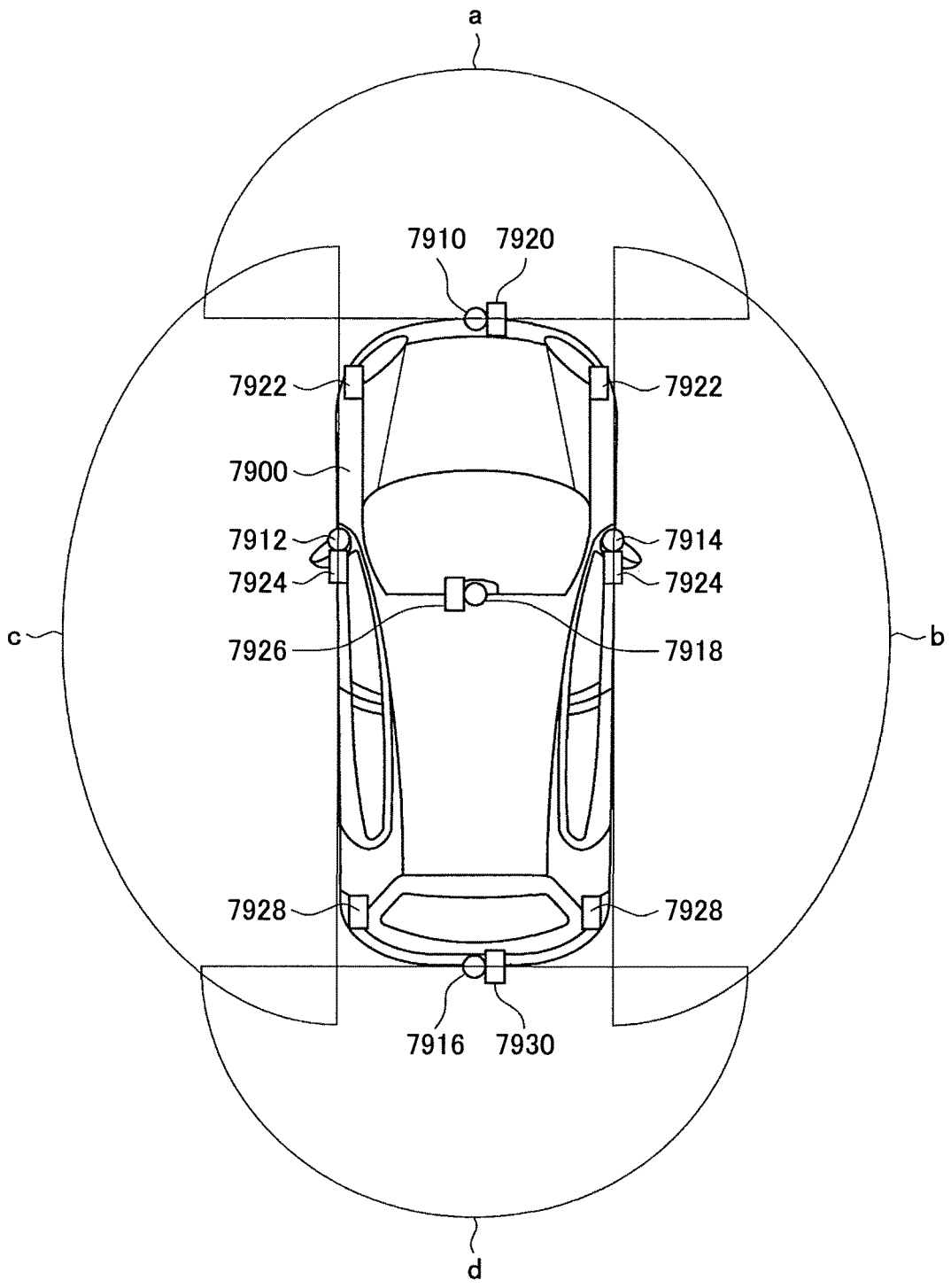
FIG. 31 is a diagram of assistance in explaining an example of installation positions of an outside-vehicle information detecting section and an imaging section.

FIG. 31 depicts an example of installation positions of the imaging section 7410 and the outside-vehicle information detecting section 7420. Imaging sections 7910, 7912, 7914, 7916, and 7918 are, for example, arranged at at least one of positions on a front nose, sideview mirrors, a rear bumper, and a back door of the vehicle 7900 and a position on an upper portion of a windshield within the interior of the vehicle. The imaging section 7910 provided to the front nose and the imaging section 7918 provided to the upper portion of the windshield within the interior of the vehicle obtain mainly an image of the front of the vehicle 7900. The imaging sections 7912 and 7914 provided to the sideview mirrors obtain mainly an image of the sides of the vehicle 7900. The imaging section 7916 provided to the rear bumper or the back door obtains mainly an image of the rear of the vehicle 7900. The imaging section 7918 provided to the upper portion of the windshield within the interior of the vehicle is used mainly to detect a preceding vehicle, a pedestrian, an obstacle, a signal, a traffic sign, a lane, or the like.

Incidentally, FIG. 31 depicts an example of photographing ranges of the respective imaging sections 7910, 7912, 7914, and 7916. An imaging range a represents the imaging range of the imaging section 7910 provided to the front nose. Imaging ranges b and c respectively represent the imaging ranges of the imaging sections 7912 and 7914 provided to the sideview mirrors. An imaging range d represents the imaging range of the imaging section 7916 provided to the rear bumper or the back door. A bird's-eye image of the vehicle 7900 as viewed from above can be obtained by overlapping image data imaged by the imaging sections 7910, 7912, 7914, and 7916, for example.

Outside-vehicle information detecting sections 7920, 7922, 7924, 7926, 7928, and 7930 provided to the front, rear, sides, and corners of the vehicle 7900 and the upper portion of the windshield within the interior of the vehicle may be, for example, an ultrasonic sensor or a radar device. The outside-vehicle information detecting sections 7920, 7926, and 7930 provided to the front nose of the vehicle 7900, the rear bumper, the back door of the vehicle 7900, and the upper portion of the windshield within the interior of the vehicle may be a LIDAR device, for example. These outside-vehicle information detecting sections 7920 to 7930 are used mainly to detect a preceding vehicle, a pedestrian, an obstacle, or the like.

Returning to FIG. 30, the description will be continued. The outside-vehicle information detecting unit 7400 makes the imaging section 7410 image an image of the outside of the vehicle, and receives imaged image data. In addition, the outside-vehicle information detecting unit 7400 receives detection information from the outside-vehicle information detecting section 7420 connected to the outside-vehicle information detecting unit 7400. In a case where the outside-vehicle information detecting section 7420 is an ultrasonic sensor, a radar device, or a LIDAR device, the outside-vehicle information detecting unit 7400 transmits an ultrasonic wave, an electromagnetic wave, or the like, and receives information of a received reflected wave. On the basis of the received information, the outside-vehicle information detecting unit 7400 may perform processing of detecting an object such as a human, a vehicle, an obstacle, a sign, a character on a road surface, or the like, or processing of detecting a distance thereto. The outside-vehicle information detecting unit 7400 may perform environment recognition processing of recognizing a rainfall, a fog, road surface conditions, or the like on the basis of the received information. The outside-vehicle information detecting unit 7400 may calculate a distance to an object outside the vehicle on the basis of the received information.

In addition, on the basis of the received image data, the outside-vehicle information detecting unit 7400 may perform image recognition processing of recognizing a human, a vehicle, an obstacle, a sign, a character on a road surface, or the like, or processing of detecting a distance thereto. The outside-vehicle information detecting unit 7400 may subject the received image data to processing such as distortion correction, alignment, or the like, and combine the image data imaged by a plurality of different imaging sections 7410 to generate a bird's-eye image or a panoramic image. The outside-vehicle information detecting unit 7400 may perform viewpoint conversion processing using the image data imaged by the imaging section 7410 including the different imaging parts.

The in-vehicle information detecting unit 7500 detects information about the inside of the vehicle. The in-vehicle information detecting unit 7500 is, for example, connected with a driver state detecting section 7510 that detects the state of a driver. The driver state detecting section 7510 may include a camera that images the driver, a biosensor that detects biological information of the driver, a microphone that collects sound within the interior of the vehicle, or the like. The biosensor is, for example, arranged in a seat surface, the steering wheel, or the like, and detects biological information of an occupant sitting in a seat or the driver holding the steering wheel. On the basis of detection information input from the driver state detecting section 7510, the in-vehicle information detecting unit 7500 may calculate a degree of fatigue of the driver or a degree of concentration of the driver, or may determine whether the driver is dozing. The in-vehicle information detecting unit 7500 may subject an audio signal obtained by the collection of the sound to processing such as noise canceling processing or the like.

The integrated control unit 7600 controls general operation within the vehicle control system 7000 in accordance with various kinds of programs. The integrated control unit 7600 is connected with an input section 7800. The input section 7800 is implemented by a device capable of input operation by an occupant, such, for example, as a touch panel, a button, a microphone, a switch, a lever, or the like. The integrated control unit 7600 may be supplied with data obtained by voice recognition of voice input through the microphone. The input section 7800 may, for example, be a remote control device using infrared rays or other radio waves, or an external connecting device such as a mobile telephone, a personal digital assistant (PDA), or the like that supports operation of the vehicle control system 7000. The input section 7800 may be, for example, a camera. In that case, an occupant can input information by gesture. Alternatively, data may be input which is obtained by detecting the movement of a wearable device that an occupant wears. Further, the input section 7800 may, for example, include an input control circuit or the like that generates an input signal on the basis of information input by an occupant or the like using the above-described input section 7800, and which outputs the generated input signal to the integrated control unit 7600. An occupant or the like inputs various kinds of data or gives an instruction for processing operation to the vehicle control system 7000 by operating the input section 7800.

The storage section 7690 may include a read only memory (ROM) that stores various kinds of programs executed by the microcomputer and a random access memory (RAM) that stores various kinds of parameters, operation results, sensor values, or the like. In addition, the storage section 7690 may be implemented by a magnetic storage device such as a hard disc drive (HDD) or the like, a semiconductor storage device, an optical storage device, a magneto-optical storage device, or the like.

The general-purpose communication I/F 7620 is a communication I/F used widely, which communication I/F mediates communication with various apparatuses present in an external environment 7750. The general-purpose communication I/F 7620 may implement a cellular communication protocol such as global system for mobile communications (GSM (registered trademark)), worldwide interoperability for microwave access (WiMAX (registered trademark)), long term evolution (LTE (registered trademark)), LTE-advanced (LTE-A), or the like, or another wireless communication protocol such as wireless LAN (referred to also as wireless fidelity (Wi-Fi (registered trademark)), Bluetooth (registered trademark), or the like. The general-purpose communication I/F 7620 may, for example, connect to an apparatus (for example, an application server or a control server) present on an external network (for example, the Internet, a cloud network, or a company-specific network) via a base station or an access point. In addition, the general-purpose communication I/F 7620 may connect to a terminal present in the vicinity of the vehicle (which terminal is, for example, a terminal of the driver, a pedestrian, or a store, or a machine type communication (MTC) terminal) using a peer to peer (P2P) technology, for example.

The dedicated communication I/F 7630 is a communication I/F that supports a communication protocol developed for use in vehicles. The dedicated communication I/F 7630 may implement a standard protocol such, for example, as wireless access in vehicle environment (WAVE), which is a combination of institute of electrical and electronic engineers (IEEE) 802.11p as a lower layer and IEEE 1609 as a higher layer, dedicated short range communications (DSRC), or a cellular communication protocol. The dedicated communication I/F 7630 typically carries out V2X communication as a concept including one or more of communication between a vehicle and a vehicle (Vehicle to Vehicle), communication between a road and a vehicle (Vehicle to Infrastructure), communication between a vehicle and a home (Vehicle to Home), and communication between a pedestrian and a vehicle (Vehicle to Pedestrian).

The positioning section 7640, for example, performs positioning by receiving a global navigation satellite system (GNSS) signal from a GNSS satellite (for example, a GPS signal from a global positioning system (GPS) satellite), and generates positional information including the latitude, longitude, and altitude of the vehicle. Incidentally, the positioning section 7640 may identify a current position by exchanging signals with a wireless access point, or may obtain the positional information from a terminal such as a mobile telephone, a personal handyphone system (PHS), or a smart phone that has a positioning function.

The beacon receiving section 7650, for example, receives a radio wave or an electromagnetic wave transmitted from a radio station installed on a road or the like, and thereby obtains information about the current position, congestion, a closed road, a necessary time, or the like. Incidentally, the function of the beacon receiving section 7650 may be included in the dedicated communication I/F 7630 described above.

The in-vehicle device I/F 7660 is a communication interface that mediates connection between the microcomputer 7610 and various in-vehicle devices 7760 present within the vehicle. The in-vehicle device I/F 7660 may establish wireless connection using a wireless communication protocol such as wireless LAN, Bluetooth (registered trademark), near field communication (NFC), or wireless universal serial bus (WUSB). In addition, the in-vehicle device I/F 7660 may establish wired connection by universal serial bus (USB), high-definition multimedia interface (HDMI (registered trademark)), mobile high-definition link (MHL), or the like via a connection terminal (and a cable if necessary) not depicted in the figures. The in-vehicle devices 7760 may, for example, include at least one of a mobile device and a wearable device possessed by an occupant and an information device carried into or attached to the vehicle. The in-vehicle devices 7760 may also include a navigation device that searches for a path to an arbitrary destination. The in-vehicle device I/F 7660 exchanges control signals or data signals with these in-vehicle devices 7760.

The vehicle-mounted network I/F 7680 is an interface that mediates communication between the microcomputer 7610 and the communication network 7010. The vehicle-mounted network I/F 7680 transmits and receives signals or the like in conformity with a predetermined protocol supported by the communication network 7010.

The microcomputer 7610 of the integrated control unit 7600 controls the vehicle control system 7000 in accordance with various kinds of programs on the basis of information obtained via at least one of the general-purpose communication I/F 7620, the dedicated communication I/F 7630, the positioning section 7640, the beacon receiving section 7650, the in-vehicle device I/F 7660, and the vehicle-mounted network I/F 7680. For example, the microcomputer 7610 may calculate a control target value for the driving force generating device, the steering mechanism, or the braking device on the basis of the obtained information about the inside and outside of the vehicle, and output a control command to the driving system control unit 7100. For example, the microcomputer 7610 may perform cooperative control intended to implement functions of an advanced driver assistance system (ADAS) which functions include collision avoidance or shock mitigation for the vehicle, following driving based on a following distance, vehicle speed maintaining driving, a warning of collision of the vehicle, a warning of deviation of the vehicle from a lane, or the like. In addition, the microcomputer 7610 may perform cooperative control intended for automatic driving, which makes the vehicle to travel autonomously without depending on the operation of the driver, or the like, by controlling the driving force generating device, the steering mechanism, the braking device, or the like on the basis of the obtained information about the surroundings of the vehicle.

The microcomputer 7610 may generate three-dimensional distance information between the vehicle and an object such as a surrounding structure, a person, or the like, and generate local map information including information about the surroundings of the current position of the vehicle, on the basis of information obtained via at least one of the general-purpose communication I/F 7620, the dedicated communication I/F 7630, the positioning section 7640, the beacon receiving section 7650, the in-vehicle device I/F 7660, and the vehicle-mounted network I/F 7680. In addition, the microcomputer 7610 may predict danger such as collision of the vehicle, approaching of a pedestrian or the like, an entry to a closed road, or the like on the basis of the obtained information, and generate a warning signal. The warning signal may, for example, be a signal for producing a warning sound or lighting a warning lamp.

The sound/image output section 7670 transmits an output signal of at least one of a sound and an image to an output device capable of visually or auditorily notifying information to an occupant of the vehicle or the outside of the vehicle. In the example of FIG. 30, an audio speaker 7710, a display section 7720, and an instrument panel 7730 are illustrated as the output device. The display section 7720 may, for example, include at least one of an on-board display and a head-up display. The display section 7720 may have an augmented reality (AR) display function. The output device may be other than these devices, and may be another device such as headphones, a wearable device such as an eyeglass type display worn by an occupant or the like, a projector, a lamp, or the like. In a case where the output device is a display device, the display device visually displays results obtained by various kinds of processing performed by the microcomputer 7610 or information received from another control unit in various forms such as text, an image, a table, a graph, or the like. In addition, in a case where the output device is an audio output device, the audio output device converts an audio signal constituted of reproduced audio data or sound data or the like into an analog signal, and auditorily outputs the analog signal.

Incidentally, at least two control units connected to each other via the communication network 7010 in the example depicted in FIG. 30 may be integrated into one control unit. Alternatively, each individual control unit may include a plurality of control units. Further, the vehicle control system 7000 may include another control unit not depicted in the figures. In addition, part or the whole of the functions performed by one of the control units in the above description may be assigned to another control unit. That is, predetermined arithmetic processing may be performed by any of the control units as long as information is transmitted and received via the communication network 7010. Similarly, a sensor or a device connected to one of the control units may be connected to another control unit, and a plurality of control units may mutually transmit and receive detection information via the communication network 7010.

7. Conclusion

As described above, according to a technique of the present disclosure, it is possible to further reduce the volume and power consumption of the blocks of the phased array antenna 200 as well as to achieve the symmetrical radiation characteristics. Further, it is possible for such a Butler matrix circuit 100 according to a technique of the present disclosure to be mounted, as a wireless communication unit or a sensor, in various wireless communication terminals, such as a smartphone, a tablet, a wearable terminal, an in-vehicle wireless module, a robot, and a drone, which are requested to reduce the volume and power consumption.

8. Supplement

Although the description has been given above in detail of preferred embodiments of the present disclosure with reference to the accompanying drawings, the technical scope of the present disclosure is not limited to such examples. It is obvious that a person having ordinary skill in the art of the present disclosure may find various alterations or modifications within the scope of the technical idea described in the claims, and it should be understood that these alterations and modifications naturally come under the technical scope of the present disclosure.

In addition, the effects described herein are merely illustrative or exemplary, and are not limitative. That is, the technique according to the present disclosure may achieve, in addition to or in place of the above effects, other effects that are obvious to those skilled in the art from the description of the present specification.

It is to be noted that the technical scope of the present disclosure also includes the following configurations.

(1)

A Butler matrix circuit including:

four processing-circuit-side terminals;

four antenna-side terminals;

a first 90° hybrid coupler coupled to a first processing-circuit-side terminal and a second processing-circuit-side terminal;

a second 90° hybrid coupler coupled to a third processing-circuit-side terminal and a fourth processing-circuit-side terminal;

a third 90° hybrid coupler coupled to a first antenna-side terminal and a third antenna-side terminal;

a fourth 90° hybrid coupler coupled to a second antenna-side terminal and a fourth antenna-side terminal;

a first 90° delay circuit provided between the first 90° hybrid coupler and the third 90° hybrid coupler; and a second 90° delay circuit provided between the first 90° hybrid coupler and the fourth 90° hybrid coupler, the second 90° hybrid coupler being directly coupled to the third and fourth 90° hybrid couplers.

(2)

The Butler matrix circuit according to (1), in which the first to fourth 90° hybrid couplers and the first and second 90° delay circuits each include a transmission line provided on a substrate.

(3)

The Butler matrix circuit according to (2), in which the substrate includes a glass substrate or a silicon substrate.

(4)

The Butler matrix circuit according to (1) or (2), further including:

a first 180° delay circuit provided between the third 90° hybrid coupler and the third antenna-side terminal; and a second 180° delay circuit provided between the fourth 90° hybrid coupler and the fourth antenna-side terminal.

(5)

A phased array antenna including:

one or a plurality of Butler matrix circuits; and an array antenna including a plurality of antennas, each of the plurality of Butler matrix circuits including four processing-circuit-side terminals, four antenna-side terminals, a first 90° hybrid coupler coupled to a first processing-circuit-side terminal and a second processing-circuit-side terminal, a second 90° hybrid coupler coupled to a third processing-circuit-side terminal and a fourth processing-circuit-side terminal, a third 90° hybrid coupler coupled to a first antenna-side terminal and a third antenna-side terminal, a fourth 90° hybrid coupler coupled to a second antenna-side terminal and a fourth antenna-side terminal, a first 90° delay circuit provided between the first 90° hybrid coupler and the third 90° hybrid coupler, and a second 90° delay circuit provided between the first 90° hybrid coupler and the fourth 90° hybrid coupler, the second 90° hybrid coupler being directly coupled to the third and fourth 90° hybrid couplers, and the respective antennas being coupled to the first to fourth antenna-side terminals of each of the Butler matrix circuits.

(6)

The phased array antenna according to (5), including:

one of the Butler matrix circuits; and the array antenna including four of the antennas that are coupled, respectively, to the first to fourth antenna-side terminals of the Butler matrix circuit.

(7)

The phased array antenna according to (6), in which the four antennas are arranged in two rows and two columns.

(8)

The phased array antenna according to (7), in which the Butler matrix circuit further includes a first 180° delay circuit provided between the third 90° hybrid coupler and the third antenna-side terminal, and a second 180° delay circuit provided between the fourth 90° hybrid coupler and the fourth antenna-side terminal.

(9)

The phased array antenna according to (8), in which two of the antennas arranged in an identical row or in an identical column have a shape in a relationship of 180° inversion from each other in the array antenna to thereby form the first and second 180° delay circuits.

(10)

The phased array antenna according to (9), in which a first antenna disposed in a first row and a first column and coupled to the first antenna-side terminal and a second antenna disposed in a second row and the first column and coupled to the third antenna-side terminal have a shape in a relationship of 180° inversion from each other, and a third antenna disposed in the first row and a second column and coupled to the second antenna-side terminal and a fourth antenna disposed in the second row and the second column and coupled to the fourth antenna-side terminal have a shape in a relationship of 180° inversion from each other.

(11)

The phased array antenna according to (5), including:

four of the Butler matrix circuits; and the array antenna including sixteen of the antennas coupled to the respective antenna-side terminals of the Butler matrix circuits.

(12)

The phased array antenna according to (11), in which the sixteen antennas are arranged in four rows and four columns.

(13)

The phased array antenna according to (12), in which, in the array antenna, the antennas arranged in even-numbered rows of each column have a shape of 180° inversion of the antennas arranged in odd-numbered rows of an identical column, or the antennas arranged in even-numbered columns of each row have a shape of 180° inversion of the antennas arranged in odd-numbered columns of an identical row.

(14)

The phased array antenna according to any one of (11) to (13), in which the first processing-circuit-side terminal of each of the Butler matrix circuits is coupled to a first terminal, the second processing-circuit-side terminal of each of the Butler matrix circuits is coupled to a second terminal, the third processing-circuit-side terminal of each of the Butler matrix circuits is coupled to a third terminal, the fourth processing-circuit-side terminal of each of the Butler matrix circuits is coupled to a fourth terminal, and the first to fourth terminals are coupled to a processing circuit including a switch circuit.

(15)

The phased array antenna according to (14), in which the first to fourth processing-circuit-side terminals are coupled, respectively, to the first to fourth terminals via dividers.

(16)

A front-end module including:

a Butler matrix circuit;

an array antenna including a plurality of antennas; and a processing circuit including a switch circuit, which are stacked on each other, the Butler matrix circuit including four processing-circuit-side terminals, four antenna-side terminals, a first 90° hybrid coupler coupled to a first processing-circuit-side terminal and a second processing-circuit-side terminal, a second 90° hybrid coupler coupled to a third processing-circuit-side terminal and a fourth processing-circuit-side terminal, a third 90° hybrid coupler coupled to a first antenna-side terminal and a third antenna-side terminal, a fourth 90° hybrid coupler coupled to a second antenna-side terminal and a fourth antenna-side terminal, a first 90° delay circuit provided between the first 90° hybrid coupler and the third 90° hybrid coupler, and a second 90° delay circuit provided between the first 90° hybrid coupler and the fourth 90° hybrid coupler, the second 90° hybrid coupler being directly coupled to the third and fourth 90° hybrid couplers.

(17)

The front-end module according to (16), including:

a first substrate; and a second substrate, which are stacked on each other, in which the Butler matrix circuit is provided on a first surface of the first substrate, the array antenna is provided on a second surface of the first substrate, and the processing circuit is provided on the second substrate.

(18)

The front-end module according to (17), in which the Butler matrix circuit and each of the antennas are electrically coupled by a via provided in the first substrate.

(19)

The front-end module according to (19), in which the Butler matrix circuit and each of the antennas are electromagnetically coupled by a slot provided in the first substrate.

(20)

A wireless communication terminal mounted with the Butler matrix circuit according to any one of (1) to (4).

(21)

The Butler matrix circuit according to any one of (1) to (4), in which a signal to be transmitted by the Butler matrix circuit includes a millimeter-wave.

REFERENCE NUMERALS LIST

100, 100*a*, 100*b*, 600 Butler matrix circuit
102 *a*, 102*b*, 102*c*, 102*d* 90° hybrid coupler
104*a*, 104*b* 90° delay circuit
106*a*, 106*b*, 116*a*, 116*b*, 116*c*, 116*d* 180° delay circuit
110*a*, 110*b*, 112*a*, 112*b* transmission line
114*a*, 114*b*, 114*c*, 114*d*, 118*a*, 118*b*, 118*c*, 118*d* divider
200, 200*a*, 200*b*, 650 phased array antenna
202, 202*a*, 202*b*, 202*c*, 202*d*, 202*e*, 202*f*, 202*g*, 202*h*, 202*i*, 202*j*, 202*k*, 202*m*, 202*n*, 202*p*, 202*q*, 202*r*, 810, 840, 916, 937 antenna
300 front-end block
302 *a*, 302*b* switch
304 *a*, 304*b* filter
306 LNA
308 PA
400, 520, 528, 530 substrate
402 front direction
404 axis
500 front-end module
502, 504, 506 layer
508*a*, 508*b*, 508*c*, 508*d* patch antenna
510*a*, 510*b*, 510*c*, 510*d*, 522, 524 via
512 wire
514 electrode pad
516 wiring line
518 terminal
526 bump
532 slot
534, 538 feeding pad
536 opening
602*a*, 602*b* 45° delay circuit
700 server
701, 901, 921 processor
702, 822, 852, 902, 922 memory
703, 903 storage
704, 823, 853 network interface
705, 7010 wireless communication network
706, 917 bus
800 eNB
820, 850 base station apparatus
821, 851 controller
825, 855, 863, 912, 933 wireless communication interface
826, 856, 913, 934 BB processor
827, 864, 914, 935 RF circuit
857, 861 coupling interface
860 RRH
900 smartphone
904 external coupling interface
906, 925 camera
907 sensor
908 microphone
909, 929 input device
910, 930 display device
911, 931 speaker
915, 936 antenna switch
918, 938 battery
919 auxiliary controller
920 car navigation apparatus
923 GPS module
926 data interface
927 content player
928 storage medium interface
940 vehicle-mounted system
941 vehicle-mounted network
942 vehicle-side module
7000 vehicle control system
7100 driving system control unit
7110 vehicle state detecting section
7200 body system control unit
7300 battery control unit
7310 secondary battery
7400 outside-vehicle information detecting unit
7410, 7910, 7912, 7914, 7916, 7918 imaging section
7420, 7920, 7921, 7922, 7923, 7924, 7925, 7926, 7928, 7929, 7930 outside-vehicle information detecting section
7500 in-vehicle information detecting unit
7510 driver state detecting section
7600 integrated control unit
7610 microcomputer
7620 general-purpose communication I/F
7630 dedicated communication I/F
7640 positioning section
7650 beacon receiving section
7660 in-vehicle device I/F
7670 sound/image output section
7680 vehicle-mounted network I/F
7690 storage section
7710 audio speaker
7720 display section
7730 instrument panel
7750 external environment
7760 in-vehicle device

7800 input section
7900 vehicle
A1, A2, A3, A4, C1, C2, C3, C4, D1, D2, D3, D4 input port
B1, B2, B3, B4, B5, B6, B7, B8, B9, B10, B11, B12, B13, B14, B15, B16 out port
P1, P2, P3, P4 port

The invention claimed is:

1. A Butler matrix circuit comprising:
four processing-circuit-side terminals;
four antenna-side terminals;
a first 90° hybrid coupler coupled to a first processing-circuit-side terminal and a second processing-circuit-side terminal;
a second 90° hybrid coupler coupled to a third processing-circuit-side terminal and a fourth processing-circuit-side terminal;
a third 90° hybrid coupler coupled to a first antenna-side terminal and a third antenna-side terminal;
a fourth 90° hybrid coupler coupled to a second antenna-side terminal and a fourth antenna-side terminal;
a first 90° delay circuit provided between the first 90° hybrid coupler and the third 90° hybrid coupler;
a second 90° delay circuit provided between the first 90° hybrid coupler and the fourth 90° hybrid coupler,
the second 90° hybrid coupler being directly coupled to the third and fourth 90° hybrid couplers;
a first 180° delay circuit provided between the third 90° hybrid coupler and the third antenna-side terminal; and
a second 180° delay circuit provided between the fourth 90° hybrid coupler and the fourth antenna-side terminal.

2. The Butler matrix circuit according to claim 1, wherein the first to fourth 90° hybrid couplers and the first and second 90° delay circuits each include a transmission line provided on a substrate.

3. The Butler matrix circuit according to claim 2, wherein the substrate includes a glass substrate or a silicon substrate.

4. A wireless communication terminal mounted with the Butler matrix circuit according to claim 1.

5. A phased array antenna comprising:
four Butler matrix circuits; and
an array antenna including a plurality of antennas, wherein sixteen antennas of the plurality of antennas are coupled to respective first to fourth antenna-side terminals of the four Butler matrix circuits,
each of the four Butler matrix circuits including
four processing-circuit-side terminals,
four antenna-side terminals,
a first 90° hybrid coupler coupled to a first processing-circuit-side terminal and a second processing-circuit-side terminal,
a second 90° hybrid coupler coupled to a third processing-circuit-side terminal and a fourth processing-circuit-side terminal,
a third 90° hybrid coupler coupled to a first antenna-side terminal and a third antenna-side terminal,
a fourth 90° hybrid coupler coupled to a second antenna-side terminal and a fourth antenna-side terminal,
a first 90° delay circuit provided between the first 90° hybrid coupler and the third 90° hybrid coupler, and
a second 90° delay circuit provided between the first 90° hybrid coupler and the fourth 90° hybrid coupler,
the second 90° hybrid coupler being directly coupled to the third and fourth 90° hybrid couplers,
the first processing-circuit-side terminal of each of the Butler matrix circuits is coupled to a first terminal,
the second processing-circuit-side terminal of each of the Butler matrix circuits is coupled to a second terminal,
the third processing-circuit-side terminal of each of the Butler matrix circuits is coupled to a third terminal,
the fourth processing-circuit-side terminal of each of the Butler matrix circuits is coupled to a fourth terminal, and
the first to fourth terminals are coupled to a processing circuit including a switch circuit.

6. The phased array antenna according to claim 5, wherein the sixteen antennas are arranged in four rows and four columns.

7. The phased array antenna according to claim 6, wherein, in the array antenna,
the antennas arranged in even-numbered rows of each column have a positional relationship of 180° inversion of the antennas arranged in odd-numbered rows of an identical column, or
the antennas arranged in even-numbered columns of each row have a positional relationship of 180° inversion of the antennas arranged in odd-numbered columns of an identical row.

8. The phased array antenna according to claim 5, wherein the first to fourth processing-circuit-side terminals are coupled, respectively, to the first to fourth terminals via dividers.

9. A front-end module comprising:
a Butler matrix circuit;
an array antenna including a plurality of antennas; and
a processing circuit including a switch circuit, which are stacked on each other,
the Butler matrix circuit including
four processing-circuit-side terminals,
four antenna-side terminals,
a first 90° hybrid coupler coupled to a first processing-circuit-side terminal and a second processing-circuit-side terminal,
a second 90° hybrid coupler coupled to a third processing-circuit-side terminal and a fourth processing-circuit-side terminal,
a third 90° hybrid coupler coupled to a first antenna-side terminal and a third antenna-side terminal,
a fourth 90° hybrid coupler coupled to a second antenna-side terminal and a fourth antenna-side terminal,
a first 90° delay circuit provided between the first 90° hybrid coupler and the third 90° hybrid coupler, and
a second 90° delay circuit provided between the first 90° hybrid coupler and the fourth 90° hybrid coupler,
the second 90° hybrid coupler being directly coupled to the third and fourth 90° hybrid couplers.

10. The front-end module according to claim 9, comprising:
a first substrate; and
a second substrate, which are stacked on each other, wherein
the Butler matrix circuit is provided on a first surface of the first substrate,
the array antenna is provided on a second surface of the first substrate, and
the processing circuit is provided on the second substrate.

11. The front-end module according to claim 10, wherein the Butler matrix circuit and each of the antennas are electrically coupled by a via provided in the first substrate.

12. The front-end module according to claim 10, wherein the Butler matrix circuit and each of the antennas are electromagnetically coupled by a slot provided in the first substrate.

* * * * *